US007011475B2

(12) United States Patent
Shiraishi

(10) Patent No.: US 7,011,475 B2
(45) Date of Patent: Mar. 14, 2006

(54) METHOD FOR PREVENTING SEISMIC LIQUEFACTION OF GROUND IN URBANIZED AREA AND FACILITIES USED IN THIS METHOD

(76) Inventor: Shunta Shiraishi, 2-4-4 Kinuta Setagaya-Ku, Tokyo (JP) 157-0073

( * ) Notice: Subject to any disclaimer, the term of this patent is extended or adjusted under 35 U.S.C. 154(b) by 0 days.

(21) Appl. No.: 10/661,576

(22) Filed: Sep. 15, 2003

(65) Prior Publication Data

US 2005/0191137 A1 Sep. 1, 2005

(30) Foreign Application Priority Data

Sep. 17, 2002 (JP) ..... 2002-269624

(51) Int. Cl.
*E02D 3/00* (2006.01)

(52) U.S. Cl. ..... 405/302.4

(58) Field of Classification Search ..... 405/263, 405/264, 128.25, 128.3, 128.2, 302.5, 302.4
See application file for complete search history.

(56) References Cited

U.S. PATENT DOCUMENTS

| | | | | |
|---|---|---|---|---|
| 823,749 | A * | 6/1906 | Wanner | 299/17 |
| 1,987,626 | A * | 1/1935 | Klie | 405/266 |
| 3,386,251 | A * | 6/1968 | Casagrande et al. | 405/302.4 |
| 3,971,222 | A * | 7/1976 | Griffith, Jr. | 405/263 |
| 4,084,381 | A * | 4/1978 | Cain et al. | 405/266 |
| 4,273,475 | A * | 6/1981 | Fuller | 405/229 |
| 4,309,129 | A * | 1/1982 | Takahashi | 405/269 |
| 4,443,260 | A * | 4/1984 | Miyoshi et al. | 106/715 |
| 4,465,518 | A * | 8/1984 | Miyoshi et al. | 106/715 |
| 4,540,316 | A * | 9/1985 | Takahashi | 405/264 |
| 4,685,835 | A * | 8/1987 | Massarsch | 405/263 |
| 4,911,584 | A * | 3/1990 | Arenzana | 405/264 |
| 5,282,699 | A * | 2/1994 | Hodge | 405/271 |
| 5,435,666 | A * | 7/1995 | Hassett et al. | 405/128.45 |
| 5,711,637 | A * | 1/1998 | I | 405/229 |
| 5,746,546 | A * | 5/1998 | Hubbs et al. | 405/263 |

(Continued)

FOREIGN PATENT DOCUMENTS

JP 62050510 A * 3/1987

(Continued)

*Primary Examiner*—Heather Shackelford
*Assistant Examiner*—Gay Ann Spahn
(74) *Attorney, Agent, or Firm*—Jacobson Holman PLLC

(57) ABSTRACT

A method of preventing seismic liquefaction of the ground in an urban area built on reclaimed land consisting of a loose fine grained layer vulnerable to liquefaction underlain with a soft cohesive layer liable to uneven settlement comprising pumping out pore water from the loose fine grained layer to lower the groundwater table to the bottom level of that layer, then injecting into the loose fine grained layer tap water saturated with air and containing micro particles of fly ash or another mineral serving as vehicles of the air into the loose fine grained layer so as to form countless tiny air bubbles and thereby reduce the degree of saturation of that layer to a level preventing seismic liquefaction.

14 Claims, 14 Drawing Sheets

U.S. PATENT DOCUMENTS

| | | | | | |
|---|---|---|---|---|---|
| 5,779,397 | A | | 7/1998 | Takemiya et al. | 405/271 |
| 5,800,090 | A | * | 9/1998 | Goughnour | 405/36 |
| 5,820,302 | A | * | 10/1998 | Roberts et al. | 405/263 |
| 5,868,525 | A | | 2/1999 | Takahashi | 405/263 |
| 5,885,026 | A | * | 3/1999 | Hwang | 405/129.7 |
| 5,927,907 | A | | 7/1999 | Shiraishi | 405/258 |
| 6,071,411 | A | * | 6/2000 | Grott | 210/638 |
| 6,089,788 | A | * | 7/2000 | Sandanasamy | 405/50 |
| 6,308,135 | B1 | * | 10/2001 | Hocking | 702/2 |
| 6,312,190 | B1 | * | 11/2001 | Goughnour | 405/36 |
| 6,508,609 | B1 | * | 1/2003 | Knight et al. | 405/229 |
| 6,511,262 | B1 | * | 1/2003 | Kang | 405/302.4 |
| 6,615,653 | B1 | * | 9/2003 | Hocking | 73/152.01 |
| 6,792,720 | B1 | * | 9/2004 | Hocking | 52/1 |
| 6,846,130 | B1 | * | 1/2005 | Goughnour | 405/50 |
| 2003/0070589 | A1 | * | 4/2003 | Boston | 106/719 |
| 2005/0063790 | A1 | * | 3/2005 | Nakakuma | 405/302.4 |

FOREIGN PATENT DOCUMENTS

| | | | |
|---|---|---|---|
| JP | 04-131427 | | 5/1992 |
| JP | 05263418 | A * | 10/1993 |
| JP | 06-057730 | | 3/1994 |
| JP | 10-102473 | | 4/1998 |
| JP | 2000-345549 | | 12/2000 |
| JP | 2001-123438 | | 5/2001 |

* cited by examiner

METHOD FOR PREVENTING SEISMIC LIQUEFACTION OF GROUND IN URBANIZED AREA AND FACILITIES USED IN THIS METHOD

BACKGROUND OF THE INVENTION

1. Field of the Invention

This invention relates to a method for preventing seismic liquefaction of loose alluvial low ground or loose reclaimed ground (hereafter two of them combined called "loose fine grained layer") in urbanized areas vulnerable to seismic liquefaction, by lowering the saturation degree of groundwater in said loose fine grained layer after pumping groundwater out of said loose fine grained layer.

The invention is applicable to very wide and extensive field of use.

Among those fields of use to which this invention is particularly applicable is the prevention of destructive seismic liquefaction of said fine grained layer in a built-up urbanized area including a harbor area vulnerable to seismic liquefaction which combined with intense tremor causes such damage as collapse of buildings, bridges, viaducts, piers, wharves, and/or outbreaks of fire due to the tremor and catastrophic spreading on of the fire due to a complete lack of water for fire fighting troops as a result of supply water pipes being torn into pieces caused by the pulling, pushing or twisting motion of the ground due to seismic liquefaction.

2. Description of the Prior Art

Liquefaction of ground is a peculiar phenomenon that occurs when a loose fine grained layer saturated with groundwater is shaken strongly by an earthquake.

This type of phenomenon can be observed when the volume of dry sand loosely filled in a container decreases when the container is shaken strongly because the pore volume of the sand decreases by the shaking down motion.

A similar phenomenon takes place when a dry loose sandy stratum is shaken strongly by an earthquake, the ground settles down because the pore volume of the ground decreases.

In the case when a dry loose sandy ground is shaken strongly, any severe damage may not be caused by it, even though appreciable settlement of the ground surface may take place.

However, in the case when said loose fine grained layer where the volume of porous void in said stratum is filled with groundwater which is called "pore water" or when said layer is saturated with the pore water which is not as compressible as air is, the motion to decrease pore volume due to strong shaking action causes a sudden rise of pore water pressure much in excess of the normal hydrostatic pressure causing the effective contact pressure between soil grains which is called "effective overburden pressure" enacted by the weight of the ground less the buoyancy of a submerged portion of ground above a depth level, to diminish to null so as to create a state as though soil grains drift in the pore water.

This peculiar phenomenon is called liquefaction of ground.

When seismic liquefaction of ground occurs, any obstacle in the ground lighter in unit weight than the ground floats up and anything heavier in unit weight than the ground sinks down.

The liquefied ground loses its bearing capacity to cause such a destructive damage as collapse of buildings, bridges, viaducts, wharfs, piers or other types of structure.

Also such a disastrous hazard of an overwhelming fire, a great many casualties and a tremendous loss of properties may be caused by break open buried lifelines of pipes and ducts for feeding water, gas, electric power or for communication lines as the liquefied ground flows slowly toward a low side even on a slope of very slight gradient and the solid ground above the groundwater table where the pipes or ducts of lifelines are buried in it moves together with the flowing liquefied ground beneath the ground water table which induces compression or extraction of the solid ground to tear or crush forcibly the buried lifelines.

The likewise break open of a sub-aqueous tunnel leading into the low level areas may cause deadly flood in the low level area caused by high tide or Tsunami induced by the movement of active faults below sea floor to torture many helpless people by drowning or starving.

The physical property of the ground vulnerable to seismic liquefaction was defined to be that (1) relative density 75% or less, (2) grain-size uniformity factor 10 or less (3) 50% grain diameter D50 0.074 mm to 2.0 mm and that (4) effective overburden pressure 0.20 MPa (2 kgf/sq.cm) or less.

However, in violent Hyogoken Nambu Great Earthquake of 1995, liquefaction occurred in the ground of sandy gravel where D50 is much larger than 2.0 mm and in the ground in a loose fill with an "apparent cohesion" containing an appreciable amount of fine particles smaller than 0.074 mm in diameter which behaves like a cohesive soil while it is not fully saturated with the pore water contained in it, its apparent cohesion is lost when it is fully saturated with the pore water in it.

Such a ground with an apparent cohesion is vulnerable to seismic liquefaction, it is found in many cases where the reclaimed fill overlaying the soft cohesive layer called New Bay Mud is prevailing along the sea shores and below the sea bed of San Francisco Bay and California Bay or in the loose fill made of disintegrated soil dredged out of New Bay Mud.

Severe liquefaction of ground occurred in the above mentioned loose fill caused by recent intense earthquakes including Loma Prieta Earthquake of 1989.

The prior countermeasures for preventing seismic liquefaction of ground are, (1) methods to improve the ground so that liquefaction of it does not occur even though it is shaken by an intense earthquake and (2) methods to renew or to retrofit the existing structures or underground utilities so that they are not fatally damaged even when a liquefaction of ground occurs.

Among the aforementioned countermeasures by improving the property of ground is A. a method to increase the density of ground by compacting the ground, B. a method to solidify ground by injecting chemical fluids into the ground, C. a method to replace the ground with better soil and D. a method to lower the saturation degree of pore water contained in the ground.

The prior method to increase the density of ground by compacting the ground by means of powerful vibro-hammers or impact hammers mounted on a large crawler-mount pile driving rig and the like is not only very expensive but also extremely difficult to apply in a built-up urban area or in a harbor area where there is not any vacant space which is not occupied by containers. such an activity as busy road traffic nor occupied by containers and/or container lifting cranes installed on wharfs and piers because it requires detouring of traffic or removal of container and cranes to make room for the large pile driving rig with its outriggers fully extended to be ready for its work.

The method using the above mentioned tall large rigs is neither applicable to the place with narrow space nor to the place below an overpass girder where the head clearance is low.

The application of the said method to increase the density of ground to built-up urban areas or to harbor areas is impracticable.

The prior method of solidifying the ground or of replacing the ground with better soil is more expensive than said method of increasing density of ground because the former requires a large amount of chemicals of high price and the latter a large amount of good soil of high price and the cost for removing the original ground and additional cost of a borrow pit and carrying good soil from the borrow pit to refilling site.

Said methods for preventing seismic liquefaction of ground by increasing the density of ground, by solidifying the ground, by replacing the ground with good soil are much too expensive and their application covering wide areas is impracticable because it requires a huge amount of funds which is much in excess of the fund rising ability of any organization concerned.

Prior methods proposed to renew and/or to retrofit the existing structures or underground utilities requires a tremendous amount of funding because there are a great many quantity of the existing structures and/or underground utilities to be renewed and/or retrofitted in a built-up urban area.

Therefore, the application of these methods is practicable only in a very limited scope.

The three billion US dollar long range seismic retrofit program presently being enforced by California Department of Transportation (Caltran) to reinforce eighteen toll bridges spanning across San Francisco Bay and California Bay is an example of said method for preventing seismic damage caused principally by liquefaction of ground where the funds required for said retrofit program is being raised by issuing long-term bonds to be refunded by allocating an important portion of the reserve raised out of toll revenue.

The above Caltran's retrofit program is an example where the object of application is limited solely to the toll bridges financed by their toll revenue.

Whereas there are a great many aging structures and/or deteriorated buried life lines of pipes and ducts required to be renewed and/or retrofitted in the urbanized areas in the State of California alone.

The above description regarding the program for preventing seismic damage provided in the American Continents including said three billion dollar seismic retrofit program has been quoted from the literatures written by and the information afforded by Ben C. Gerwick, Jr., Honorary Member of American Society of Civil Engineers who has been assigned by Caltran to be a consulting engineer playing an important role in engineering the Caltran's retrofit program.

Prior methods proposed for lowering the saturation degree of pore water (water in porous voids of ground) contained in a ground where the saturation degree is defined to be the ratio in percent of the volume of pore water to the total volume of porous void in the ground is further divided into the method of lowering ground water level by means of deep wells and the like, and the method of blowing compressed air into the ground.

By said method utilizing deep wells or the like, the ground water is pumped out for lowering the groundwater table.

This method involves the problem of land subsidence due to the consolidation of soft strata caused by the lowering of the ground water table and thus its application to built-up urban areas is impracticable.

The present invention belongs to said method D among the countermeasures for preventing seismic liquefaction of ground without any of the disadvantages associated with the prior methods of lowering the saturation degree of pore water in the ground.

Those methods patented by the United States Patent and Trademark Office that fall into the above mentioned category and sorted out of the U.S. patent data base by the courtesy of Jotaro Iwabuchi, Ph.D. PE meeting the demand of the claimant for the patent of the present invention, are as follows: U.S. Pat. No. 5,927,907 "Method and apparatus for preventing liquefaction of ground caused by earthquake", U.S. Pat. No. 5,868,525 "Method of preventing damage to loose sand ground or sandy ground due to seismic liquefaction phenomenon, and of restoration of disaster-stricken ground", U.S. Pat. No. 5,800,090 "Apparatus and method for liquefaction remedy of liquefiable soils", and U.S. Pat. No. 5,779,397 "Method of improving against vibration and liquefaction".

Those Japanese patented methods which fall in said category were sorted also by the courtesy of Jotaro Iwabuchi, Ph.D. PE out of the data base of Electronic Library of Japanese Patent Board are: Published JP-A-2001-123438 "Method for preventing seismic liquefaction of ground in urbanized area by injecting air-solved water or compressed air and facilities used in the method", JP-A-2000-345549 "Method for preventing liquefaction of ground by making air-solved water permeate into ground", Published JP-A-2001-1930498 "Method for improving ground and quality of water by injecting gas solved in water", Published JP-A-H10-102473 "Method for preventing liquefaction of sand and sandy ground" and Published JP-A-H06-57730 "Method for preventing liquefaction of ground by using burnt ash".

Among the above mentioned patents, the U.S. Pat. No. 5,927,907 and the Japanese Patent of Published JP-A-H10-338989, Published JP-A-2001-123438 and Published JP-A-2000-345549 are invented by and granted to the claimant for a patent of the present invention.

However, every one of the above quoted patented methods for preventing seismic liquefaction of ground by lowering the saturation degree in ground has the drawback as described in the following paragraph.

The main feature common in the above quoted patented methods is to form an air mixed zone in the ground by such a means of injecting compressed air or by a similar means.

However, every one of the above quoted patented methods has a disadvantage in that the air-mixed zone thus formed develops in a limited extent because the countless tiny air bubbles swarmed in said air mixed zone concentrate around the outlet of the source of feeding said air bubbles to minimize further expansion of the air mixed zone.

According to the data base CLIPPEDIMAGE-JA404131427A, Patent JP-A-H04-131427: "Prevention of ground from liquefaction", PUBN DATE: May 6, 1992, Inventors: K. Tomaoki, N. Mori, M. Sato and Y. Yoshimi, IPC: E02D27/34 US-CL-CURRENT: 40P5/267, ABSTRACT: To prevent liquefaction of the ground with the reduced underground water level in the upper water-bearing stratum by providing a cut-off wall-impermeable layer and making a wall reaching the lower water-bearing stratum in the inside of the cut-off wall conducting the underground water of the upper water-bearing stratum to the lower water-bearing stratum through the well (to aerate the upper water-bearing stratum so as to lower the saturation degree of the upper water-bearing stratum for making it being not liquefied at the time of a violent earthquake).

The above mentioned method for preventing liquefaction of ground, where the description in parentheses was added for making the effect achieved by the method clear, is applicable to a limited extent of the ground within the width between the cut-off walls beneath the building before it is built.

There are a number of patented methods for preventing seismic liquefaction of ground similar to the one described above.

However, they are applicable to a limited extent of ground within limited spaces.

There are many prototype examples where the structure built on pneumatic caissons surrounded by loose fine grained strata are vulnerable to seismic liquefaction of said loose ground.

The earliest recorded typical example is the Bandai Bridge based on pneumatic caissons built in 1947 supporting the main spans of continuous arch endured Niigata Earthquake of 1964 when it was shaken by the tremor of 0.3 g (g is the acceleration of gravity) in maximum horizontal acceleration without any damage affecting the loading capacity of its main arch spans while many other structures fatally damaged due to the seismic liquefaction of the loose sandy layer several meter in depth below groundwater table.

According to the theory of groundwater hydrology such tiny air bubbles smaller in diameter than 1 mm closed in the pore voids of a loose sandy layer stay in there permanently as long as no such a radical change in groundwater as drying up by heating or as a turbulent flow where the rate of flow much in excess of the maximum rate of steady flow were to occur.

A typical example to verify what is described above was achieved by the soil tests made on undisturbed samples taken out of the loose fine grained layer below groundwater table, which was vulnerable to seismic liquefaction if it were saturated with water, at the position 1.5 m apart from the outside surface of one of circular pneumatic caissons supporting the piers higher than 20 m above the ground surface of Kashima Viaduct on Sanyo Shinkansen Rail Line in Osaka City.

A series of laboratory tests made on said samples of loose sandy soil were made carefully to determine the value of saturation degree of them.

Saturation degree is a volumetric ratio in % of pore water to the total pore voids.

The values of saturation degree thus examined were in the range from 83.5% to 92.4% and it verified said theory.

The present invention is composed for the object to solve those problems that have not been solved by the prior method for preventing seismic liquefaction of ground.

Therefore, the present invention will be composed for solving those problems in the manner as summarized below.

SUMMARY OF THE INVENTION

A first object of the present invention is to provide a method for preventing seismic liquefaction of the ground, in such a built-up urbanized area where a loose fine grained layer vulnerable to seismic liquefaction is underlain with a soft cohesive layer which is liable to uneven settlement caused by lowering of groundwater table, comprises a couple of sequential stages described in the following paragraphs.

The first stage is to lower the groundwater table down to the bottom level of loose fine grained layer by pumping pore water out of it until all the pore voids of it are aerated being the groundwater thus pumped out made to flow down through the soft cohesive layer and further down into the deep granular layer underlying said soft cohesive layer while a proper amount of compressed air at the pressure suitably higher than the groundwater pressure at the top level of said deep granular layer supplied into said deep granular layer, with the effect that the uplift force of said compressed air supplied reciprocally with the groundwater counteracts the downward force caused by lowering groundwater table in said loose fine grained layer.

This prevents any uneven settlement harmful to buried utilities like gas pipes.

In the second stage, a suitable amount of tap-water which is made overly saturated with air dissolved in it and its pressure is regulated suitably higher than the initial groundwater pressure at the top level of soft cohesive layer (hereinafter called said tap-water) wherein an adequate dose of micro particles of silica or the like in selected particle size and chemically treated to be useful and harmless for the purpose of underground use and also with a dose of diffusing agent required for preventing aggregation of said micro particles (hereinafter called said mineral powder) is blended in a regulating tube.

Said tap-water is injected into the aerated pore voids of loose fine grained layer in a steady flow until said pore voids are fully filled up with said tap-water.

Then, the supply water valve is closed to make the head level of said tap-water fall down to the initial groundwater level so as to form an air-mixed zone of countless tiny air bubbles in the pore water of loose fine grained layer.

These bubbles out of said tap-water swarming around cores of micro particles of said mineral powder lower the saturation degree therein down to the level at which no seismic liquefaction takes place even at the time of a violent earthquake.

A second object of the present invention is to provide a method for preventing seismic liquefaction of ground, as defined by the first object mentioned afore, using the required number of bored wells.

The depth of each one of them is divided into a top well extending down through the loose fine grained layer, a middle well extending from the bottom end of the top well down through the soft cohesive layer and a bottom well extending from the bottom end of the middle well down into the deep granular layer.

Both of the top well and the bottom well are packed fully with permeable material, each one of them being placed in a top permeable section and a deep permeable section, respectively, and the middle well packed fully with an impermeable material such as bentonite paste being placed in the middle impermeable section.

After the top permeable section is aerated and the groundwater pumped out of it is made to flow down into the deep granular layer reciprocally with the compressed air otherwise supplied making both of them combined said upward acting force, said tap-water is blended with said mineral powder.

The pressure of said tap-water is regulated through said regulating tube before it is made to flow into the loose fine grained layer.

A third object of the present invention is in providing a method for preventing seismic liquefaction of ground as defined by the first object and/or the second object mentioned afore to bore a required number of large diameter holes for the top well by means of such a method of boring holes without disturbing the ground surrounding the bored hole where casing rally be used.

The holes for the middle well and the bottom well may be bored such that the diameter of these wells is approximately half the diameter of the holes for said top well.

They can be bored by means of the boring equipment customarily used for boring deep well.

Those bored holes for the top well are to be filled up with permeable material, for the middle well are to be filled up with such an impermeable material as bentonite paste and for the bottom well are to be filled up with permeable material.

A fourth object of the present invention is in providing a method for preventing seismic liquefaction of ground as defined by the second object and/or the third object mentioned afore to make it easier for the pressurized water percolating into the clogged pore voids formed in the deep granular layer surrounding deep permeable section to form countless micro capillary tubes penetrated into the clogging of accumulated dusty particles drawn out of loose fine grained layer together with the groundwater pumped out.

This is done by blowing compressed air reciprocally with said pressurized water flow into said clogged pore voids.

A fifth object of the present invention is in providing a method for preventing seismic liquefaction of the ground as defined by the first object, the second object, the third object and/or the fourth object mentioned afore, in an event said method for preventing seismic liquefaction of ground is to be applied inside of a specified range of area where close to each one of outside peripheries of said specified range of area, there are such underground utilities, buildings and the like liable to harmful uneven settlement caused by the lowering of groundwater table in the loose fine grained layer.

A longitudinal perforated pipe is built along each one of the side peripheries of said range of area by forming a hardly-permeable barrier consisting of countless micro air bubbles fed up out of said perforated pipe with downward opening perforation, installed by means of a pipe-pushing machine such as used in small-diameter pipe pushing method or the like.

Said hardly permeable barrier is formed by countless micro air bubbles blown up out of said downward opened perforation of the longitudinal perforated pipe and it is effective to minimize the harmful uneven settlement caused by the lowering of groundwater table in said loose fine grained layer.

A sixth object of the present invention is in providing a method for preventing seismic liquefaction of ground as defined by the first object, the second object, the third object, the fourth object and/or the fifth object mentioned afore to minimize the amount of fine particles drawn out together with the groundwater flow pumped out of said loose fine grained layer by keeping the rate of flow not higher than a predetermined rate.

A seventh object of the present invention is in providing a method for preventing seismic liquefaction of ground as defined by the first object, the second object, the third object, the fourth object, the fifth object and/or the sixth object mentioned afore to prevent pumping out groundwater in excess of a predetermined minimum rate by interrupting the pumping of groundwater out of loose fine grained layer as soon as the flow-rate sensor placed inside said top well and linked electronically to the means driving said submerged pump detects a flow rate in excess of the predetermined rate.

An eighth object of the present invention is in providing a method for preventing seismic liquefaction of ground as defined by the seventh object mentioned af ore comprises providing an air compressor installed on the ground surface where the air-tight tank and an air compressor are connected to each other with an air pipe inserted in between them with an air check valve for holding a reverse flow of overly compressed air. The air-tight tank is connected with pipes to the submerged pumps installed in rows of the top well through a main water pipe with a water-check valve inserted in between them.

A reverse flow main pipe extends down into the bottom well from the air-tight tank, with a water main valve being inserted in between them.

While the submerged pumps are driving, the pumped out groundwater is pushed up into said air-tight tank and pressurized water is made to flow through the open main valve, and into the reverse flow main pipe down into the deep permeable section surrounding the bottom well until the means driving the submerged pumps interrupts its operation when the water-pressure sensor placed in the main water pipe linked electronically to the means driving the submerged pumps detects the rise of pressure in excess of a predetermined level.

The operation of submerged pumps is interrupted, closing the main valve of the reverse flow main pipe so as to suspend the flow of pressurized water into the deep permeable section.

As soon as the pressure sensor placed in the air-tight tank linked to the driving means of the air compressor detects the lowering of the pressure in said tank lower than predetermined level, the operation of the air compressor is resumed to raise the pressure in said air-tight tank and the main valve is opened to force compressed air to blow out the clog formed by accumulation of dusty particles in the layer surrounding the bottom well, thus removing the choking of said clog.

Then soon after the water-pressure sensor detects the rise of pressure in the main water pipe back to the predetermined level, the pumping of groundwater out of the loose fine grained layer by the submerged pumps is resumed and the flow of said pressurized water into the deep permeable section is resumed.

Thus the repeated cycles of pumping groundwater out of the loose fine grained layer and forcing the pumped out water flow down into the deep permeable section with intermittent blowing of compressed air into the clogged pore voids of the deep permeable section are made during the first stage of dewatering the loose fine grained layer in the top permeable section as defined in the first object of the present invention of a method for preventing seismic liquefaction of ground.

A ninth object of the present invention is in providing a method for preventing seismic liquefaction of ground as defined by the seventh object of the present invention is to prevent blowing an excessive amount of compressed air into the deep granular layer surrounding the bottom well by interrupting the driving air compressor to suspend blowing compressed air soon after the flow-rate meter linked electronically to the means driving the air compressor detects the rise of flow-rate in excess of the predetermined rate. This control is desirable because countless micro capillary tubes are pierced into the clog of dusty particles, being formed to raise the flow-rate of compressed air blowing into the bottom well, which can cause occurrence of nasty sewage odor or harmful oxygen-short air.

A tenth object of the present invention is in providing a method for preventing seismic liquefaction of ground as defined by the first object, the second object, the third object, the fourth object, the fifth object, the sixth object, the seventh object, the eighth object and/or by the ninth object of the present invention mentioned afore to achieve applying the present method for preventing seismic liquefaction of ground without interrupting the function of such a public facility as a street by accommodating such buried pipes as the main water pipe, reverse flow main water pipe, supply water pipes and the like by laying them within the periphery of an area for executing the method of the present invention, specifically in each one of the side ditches laying along each side of the roadway and the cross ditch of the roadway. Every ditch is covered with a cover board while equipment on the ground surface such as an air-tight tank or an air compressor is small and mounted on a trolley to have a low clearance for freedom of movement, thereby adapting the present invention for use in densely built-up urban areas where there is a low head clearance placed on the loose fine grained ground.

These together with other objects and advantages which will become subsequently apparent reside in the details of construction and operation as more fully hereinafter described and claimed. Reference, is made to the accompanying drawings forming a part hereof, wherein numerals refer to the parts denoted in the following description.

BRIEF DESCRIPTION OF THE DRAWINGS

FIG. 2(*b*) is a side sectional view along the center line of the roadway as illustrated in FIG. 2(*a*).

The cycle of intermittently supplied compressed air reciprocally with the pumped groundwater is repeated every time it is required for executing the pumping out stage of the method of the present invention.

Figure 2B:
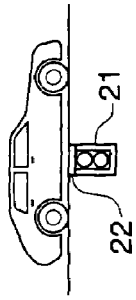
FIG. 2(*a*) is a cross sectional view on the vertical sectional plane extending through the center lines of horizontal main water pipes and vertical branch water pipes illustrating schematically an example of the equipment placed on and buried pipes in a well below the pavement of a street in a densely built-up urbanized area occupied by rows of vehicular traffic at the stage before the groundwater in said loose fine grained layer is pumped out for executing the method of the present invention.
Figure 2A:
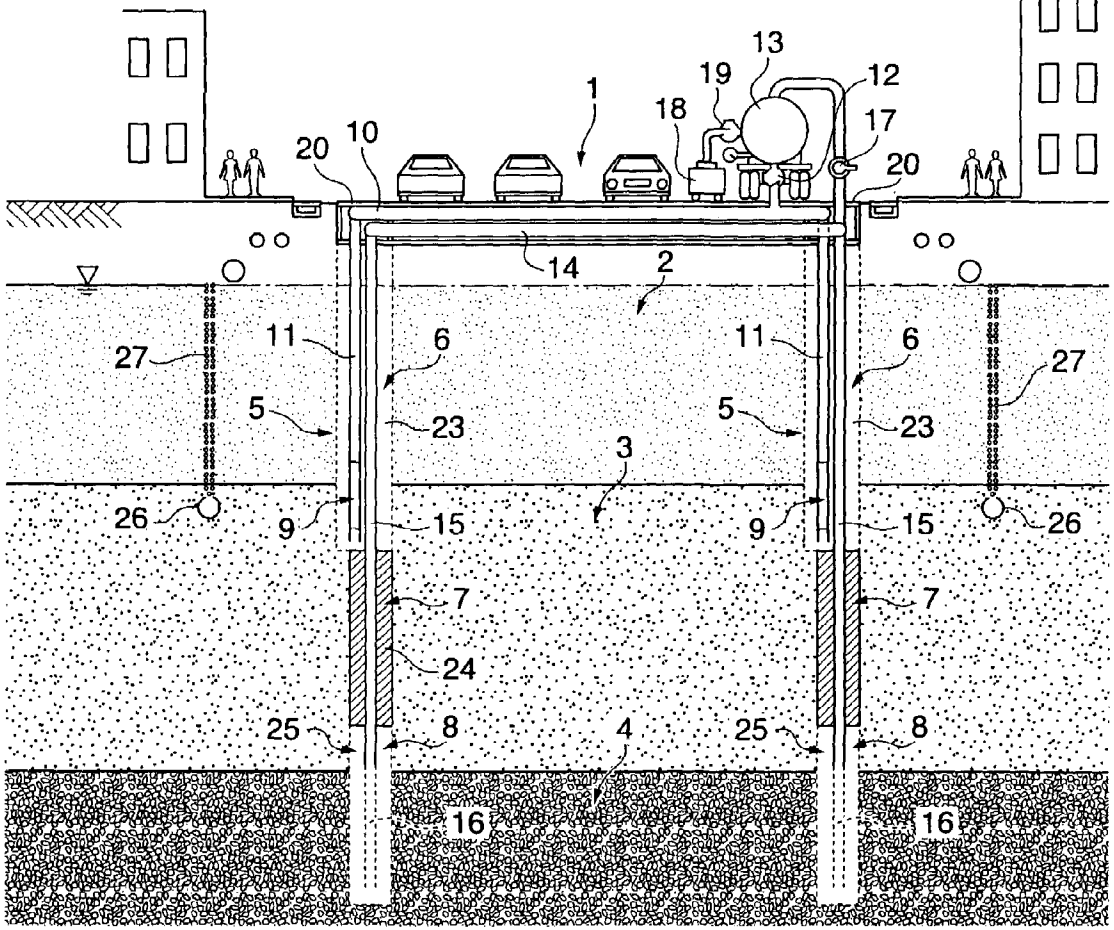
Figure 4:
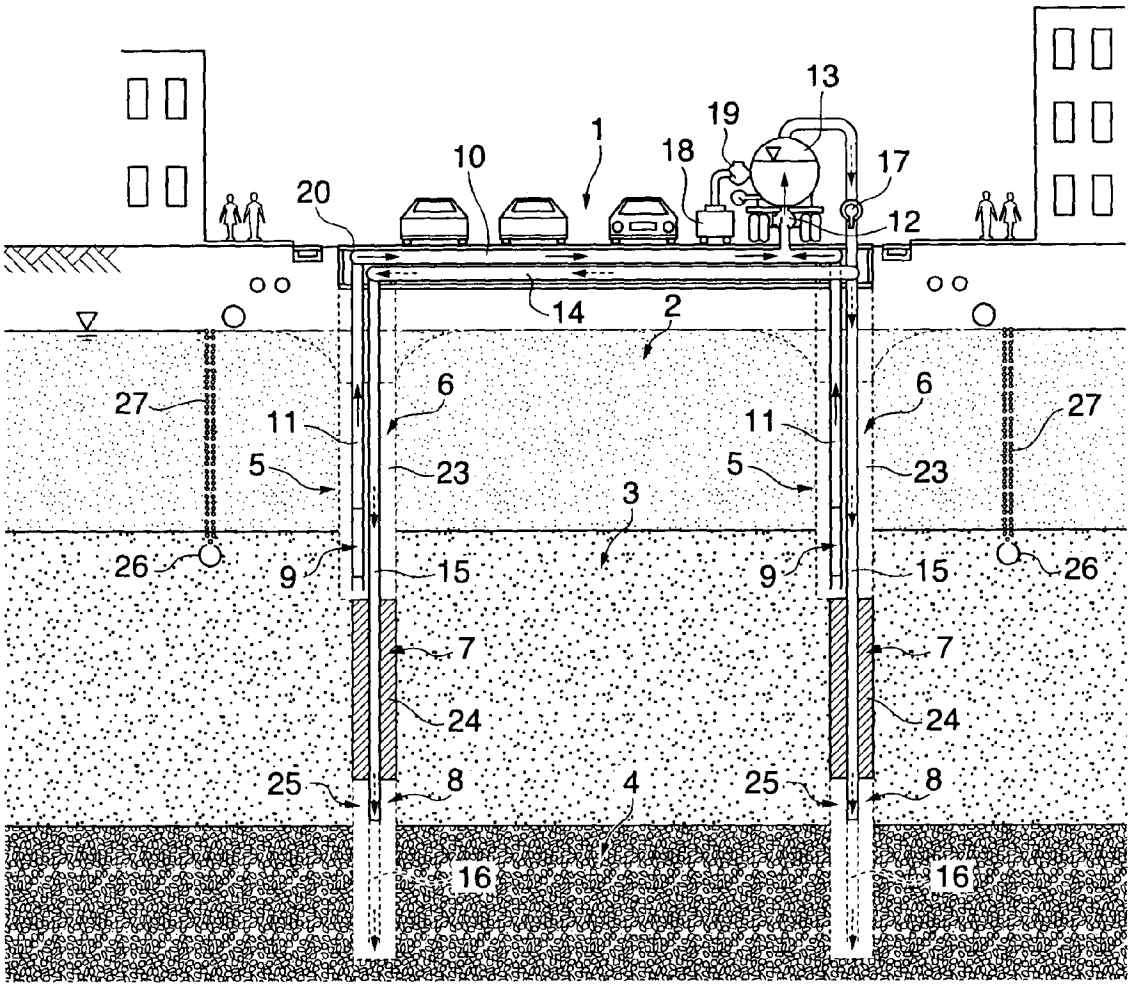

FIG. 4 is a cross sectional view as illustrated in FIG. 2(*a*) at the stage shortly after the pumping out of the groundwater from said loose fine grained layer is resumed and the compressed air is blown down into the deep granular layer for executing the pumping out stage of the method of the present invention.

Figure 5:
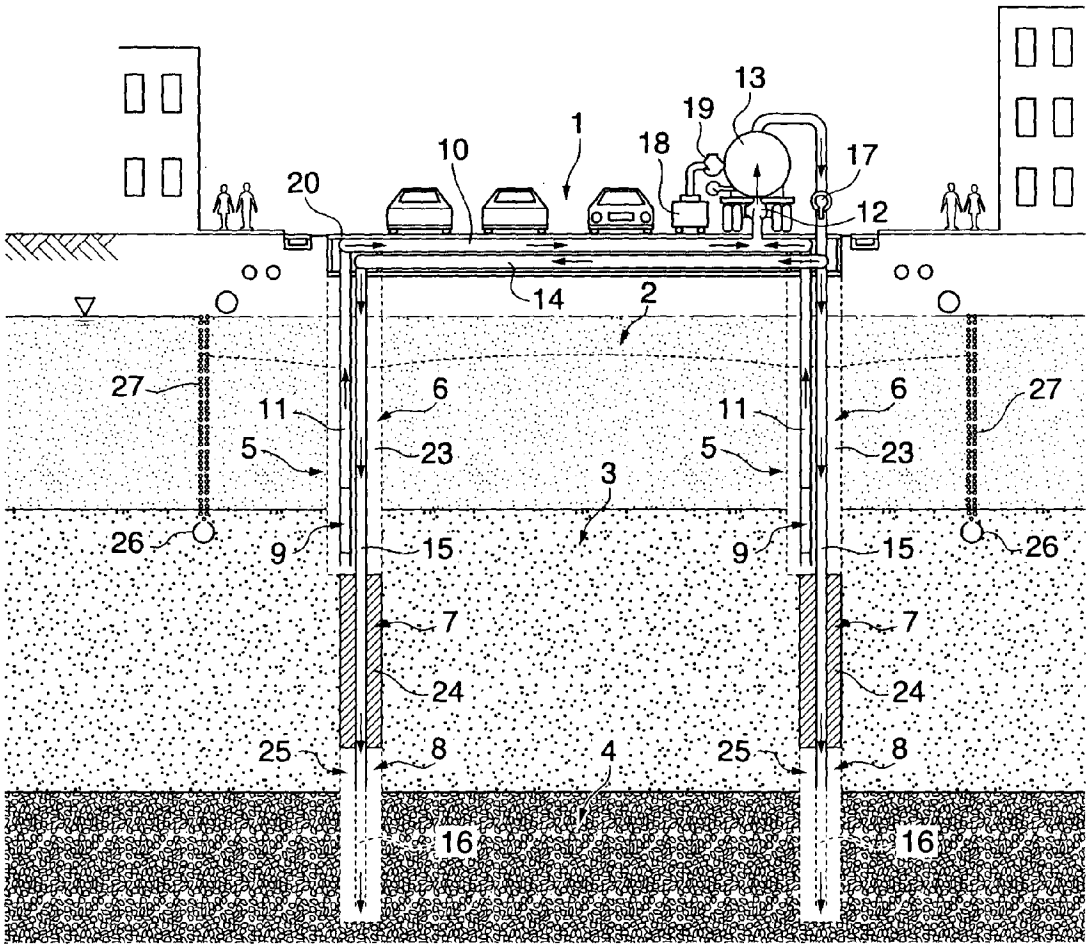

FIG. 5 is a cross sectional view as illustrated in FIG. 2(*a*) at the stage where the groundwater table in the loose fine grained layer is lowered down to a level that is approximately a quarter of the depth of said loose fine grained layer for executing the pumping out stage of the method of the present invention.

Figure 6:
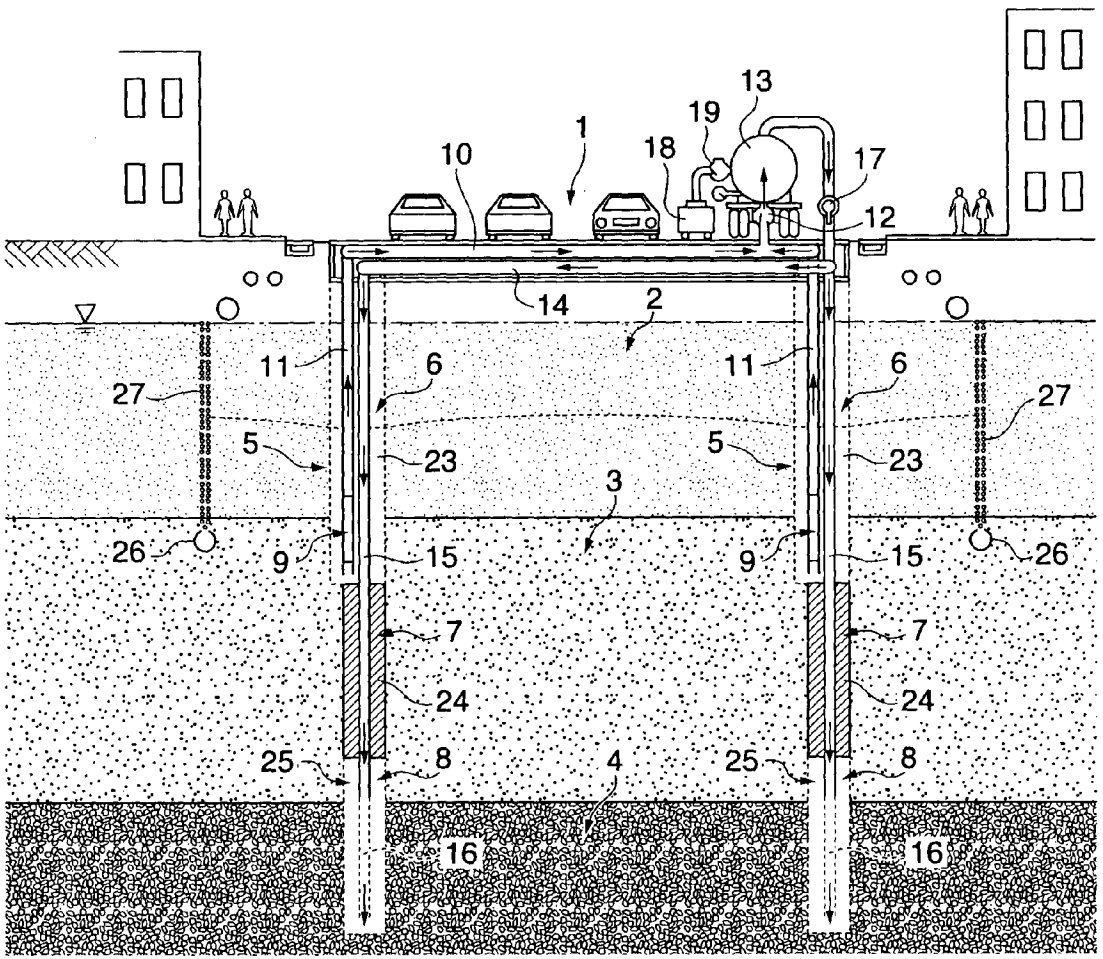

FIG. 6 is a cross sectional view as illustrated in FIG. 2(*a*) at the stage where the groundwater table in the loose fine grained layer is lowered down to the level midway of the depth of said loose fine grained layer for executing the pumping out stage of the method of the present invention.

Figure 7:
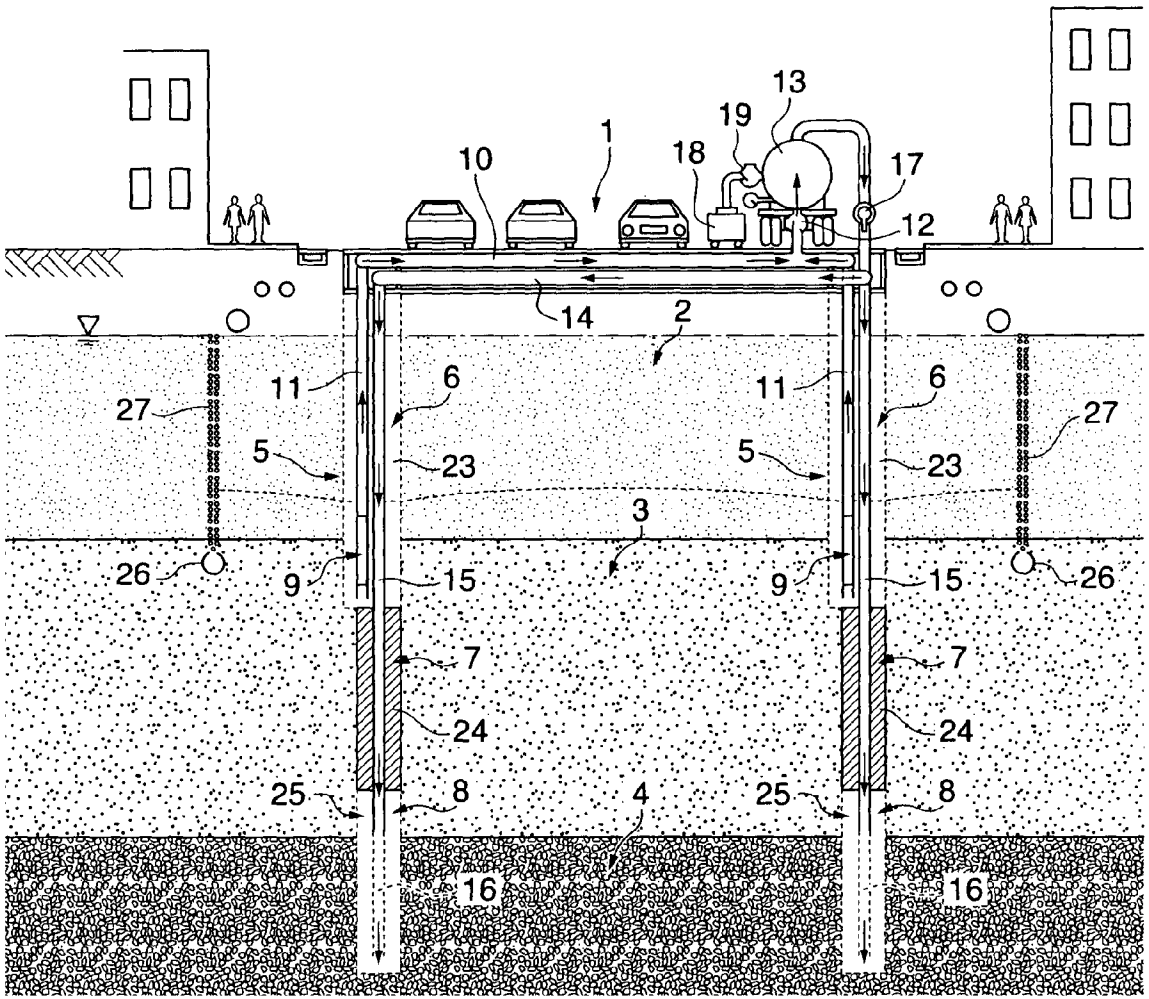

FIG. 7 is a cross sectional view as illustrated in FIG. 2(*a*) at the stage where the groundwater table in said loose fine grained layer is lowered down to the level that is three quarters of the depth of said loose fine grained layer for executing the pumping out stage of the method of the present invention.

Figure 8:
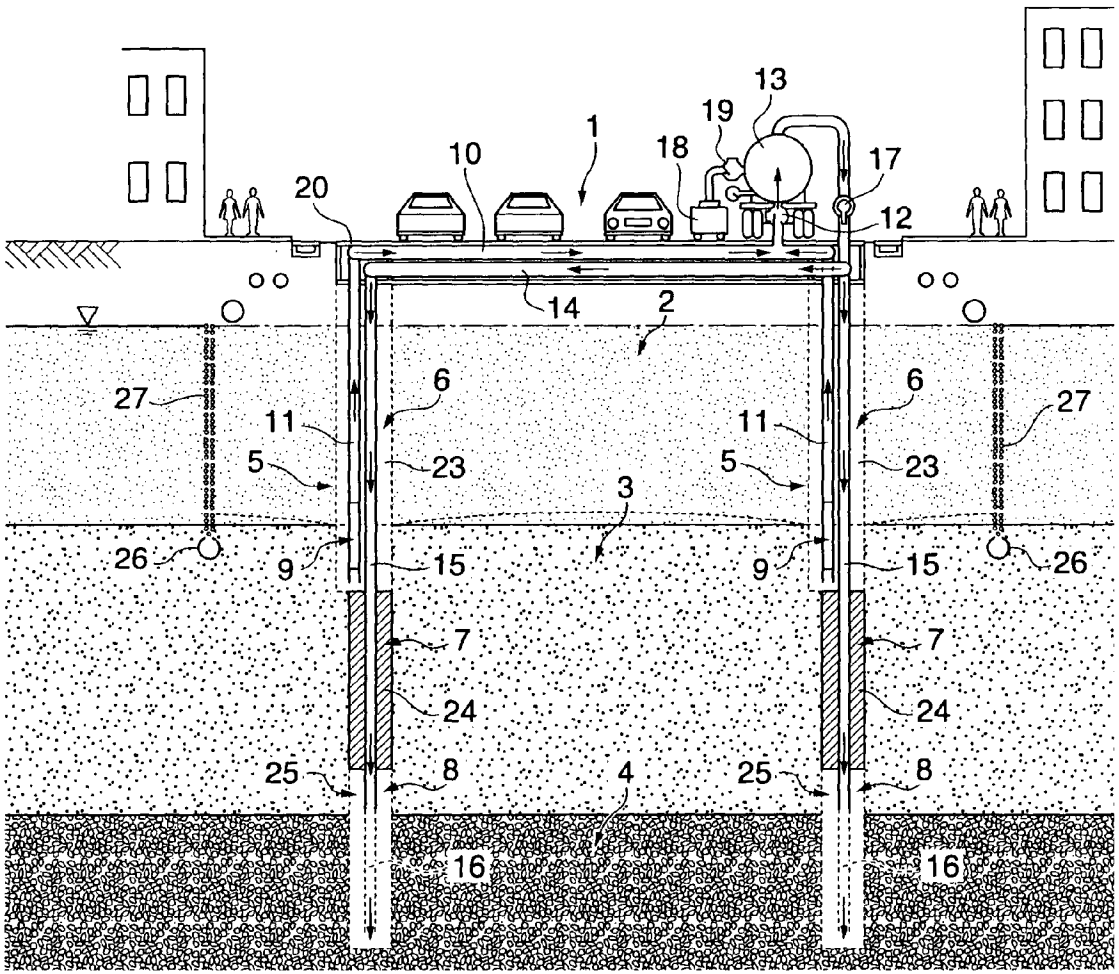

FIG. 8 is a cross sectional view as illustrated in FIG. 2(*a*) at the stage where the groundwater table in said loose fine grained layer is lowered down to the level close to the bottom of said loose fine grained layer for executing the pumping out.

Figure 9:
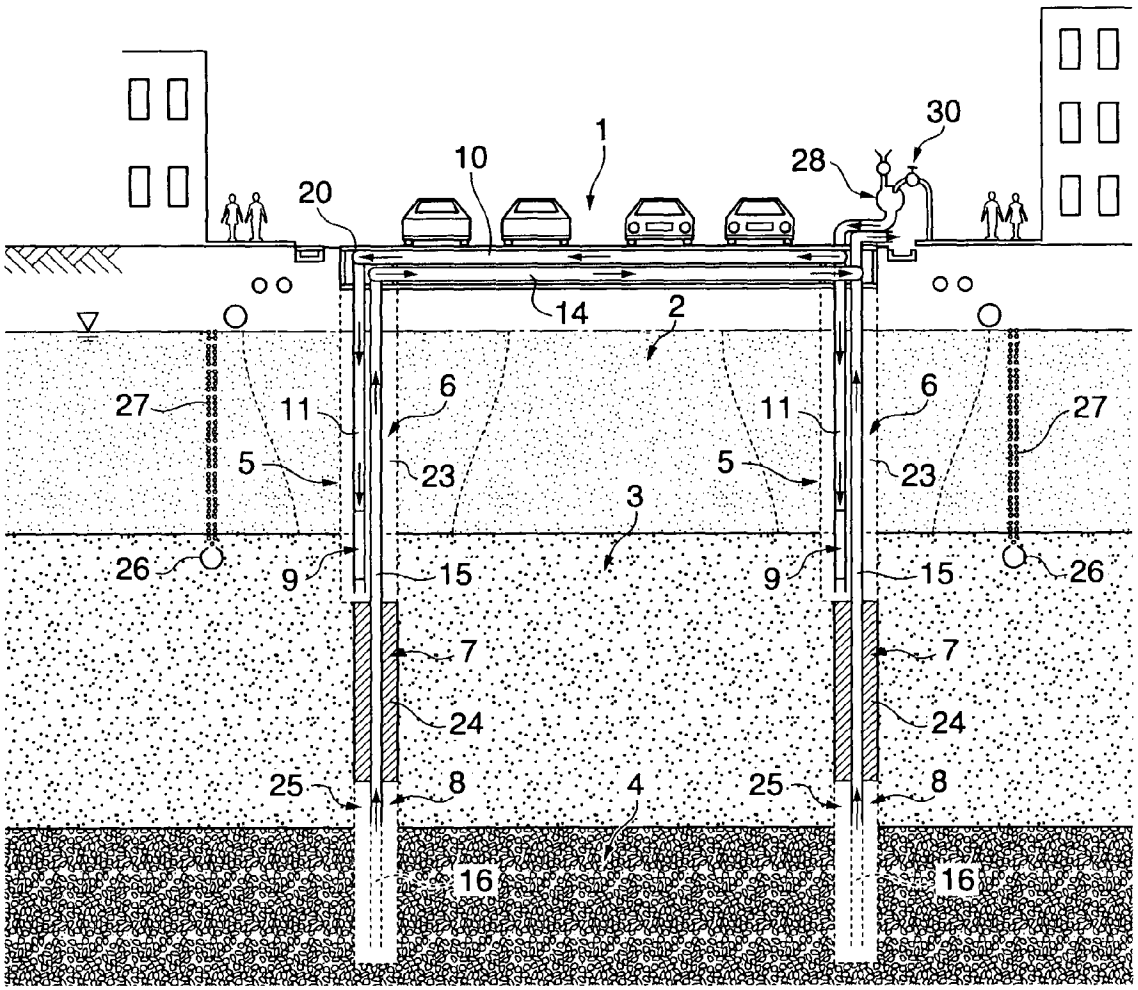

FIG. 9 is a cross sectional view as illustrated in FIG. 2(*a*) after the air compressor, the air check valve, the air-tight tank, the reverse flow main pipe placed on the pavement of a street and the main valve are removed to be replaced with a supply water tap and a regulating tube through which said tap-water supply begins to flow to permeate into said loose fine grained layer for executing said refilling stage of the method of the present invention.

Figure 10:
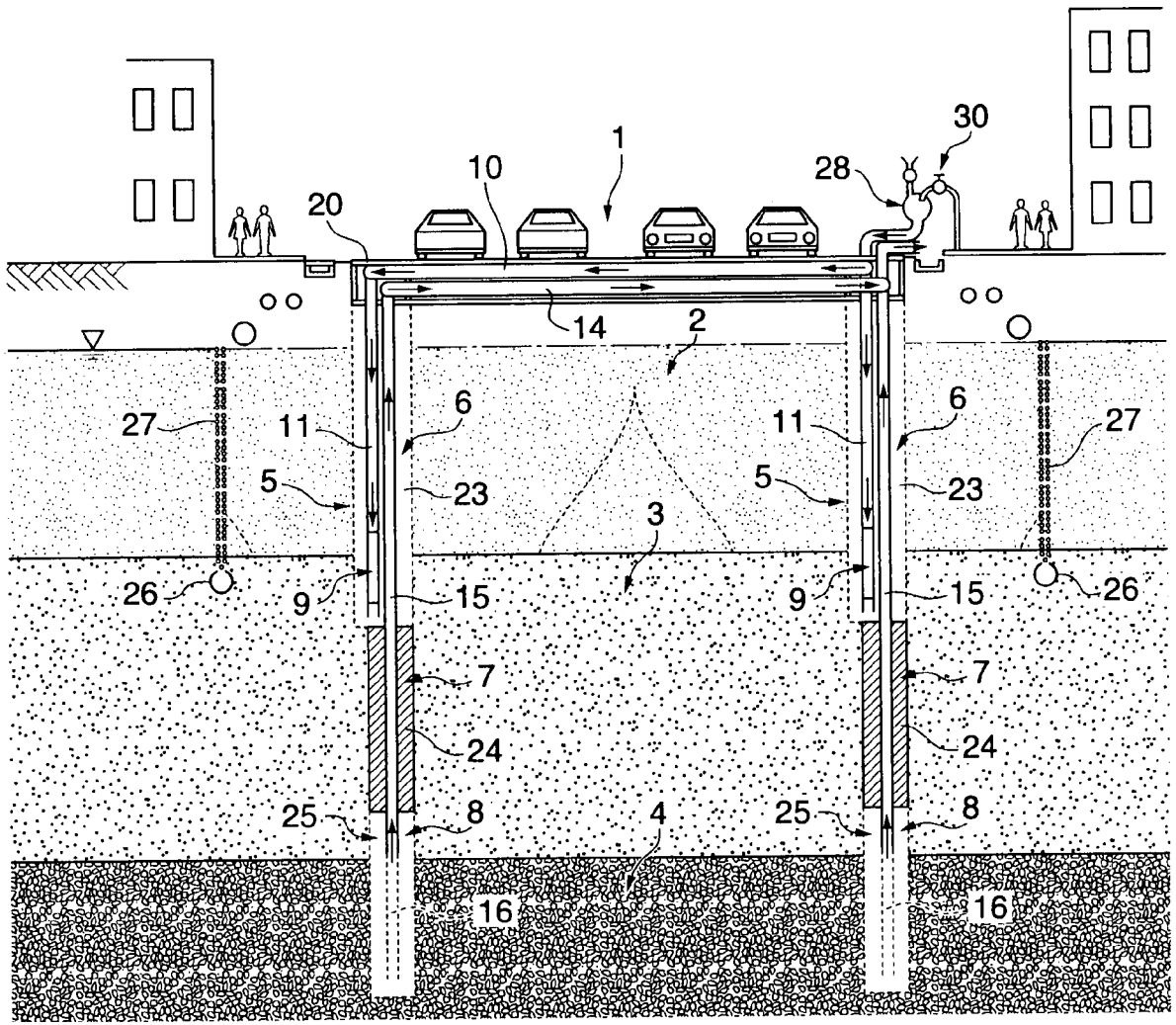

FIG. 10 is a cross sectional view as illustrated in FIG. 9 showing the refilling stage for executing the method of the present invention shortly after the foremost ends of said tap water, permeating into said loose fine grained layer out of both sides, meet together.

Figure 11:
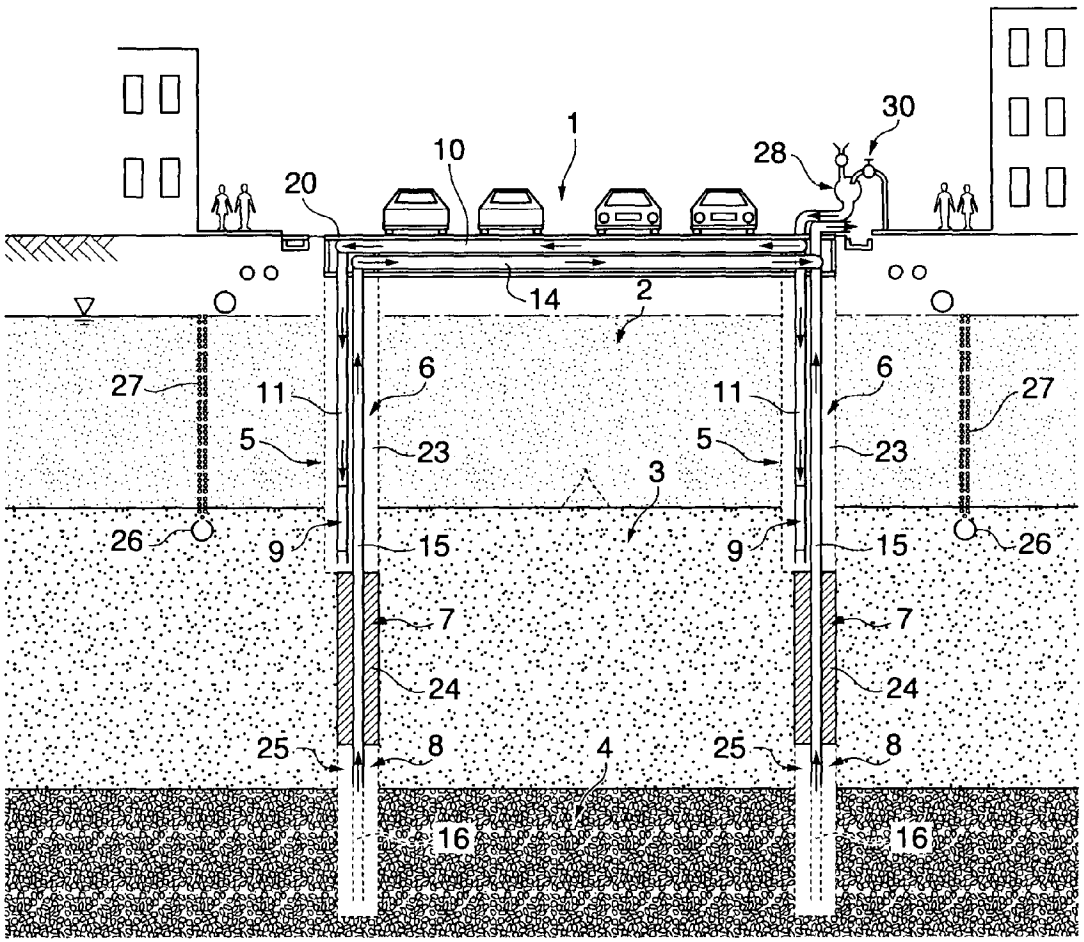

FIG. 11 is a cross sectional view as illustrated in FIG. 9 showing the stage for executing the method of the present invention shortly before the foremost ends of said tap-water permeating into said loose fine grained layer touch down at the bottom end of said loose fine grained layer.

Figure 12:
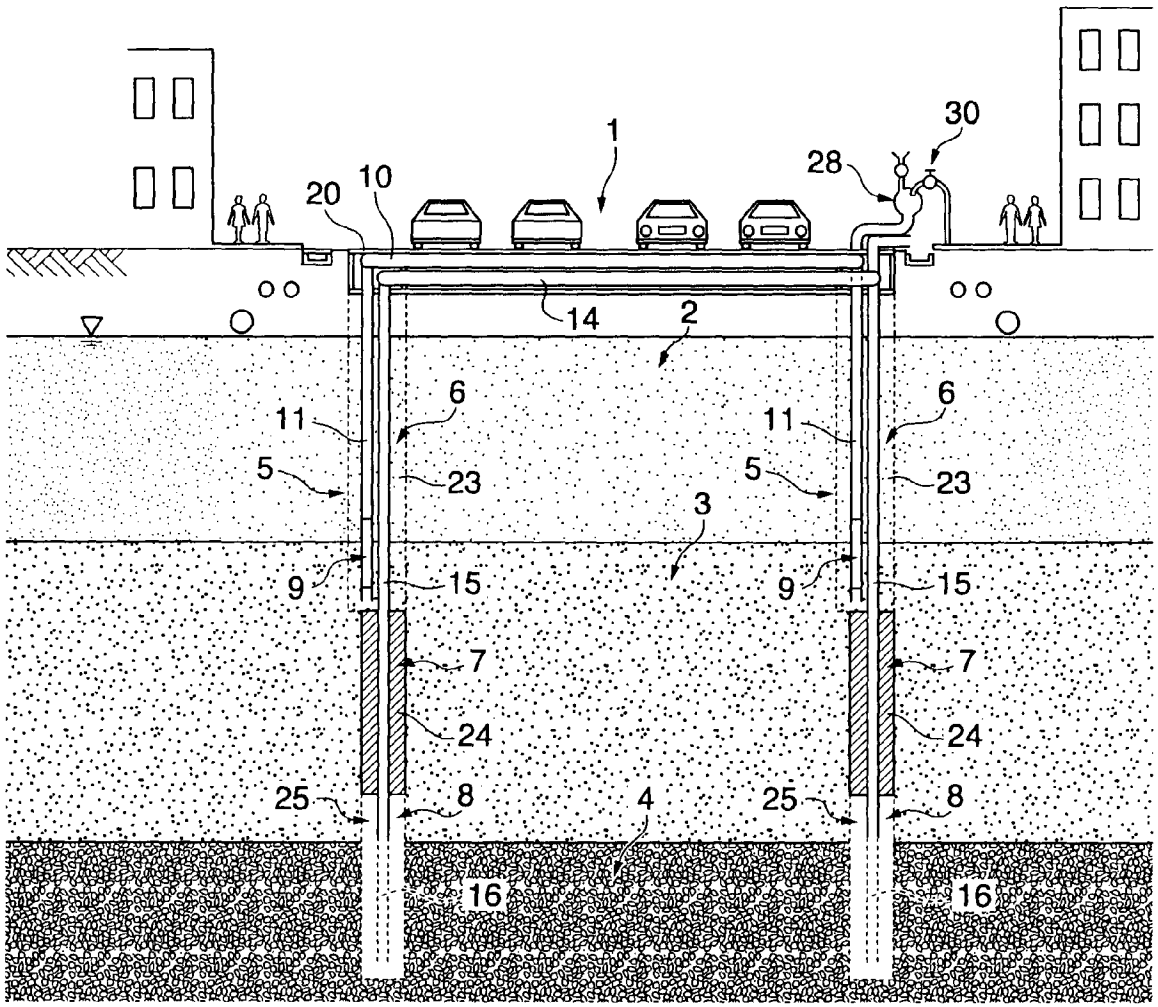

FIG. 12 is a cross sectional view as illustrated in FIG. 9 showing the stage for executing the method of the present invention shortly after the foremost ends of said tap-water permeating into said loose fine grained layer touch down at the bottom level of said loose fine grained layer in which countless tiny air bubbles come out in the pore voids of said loose fine grained layer.

Figure 13:
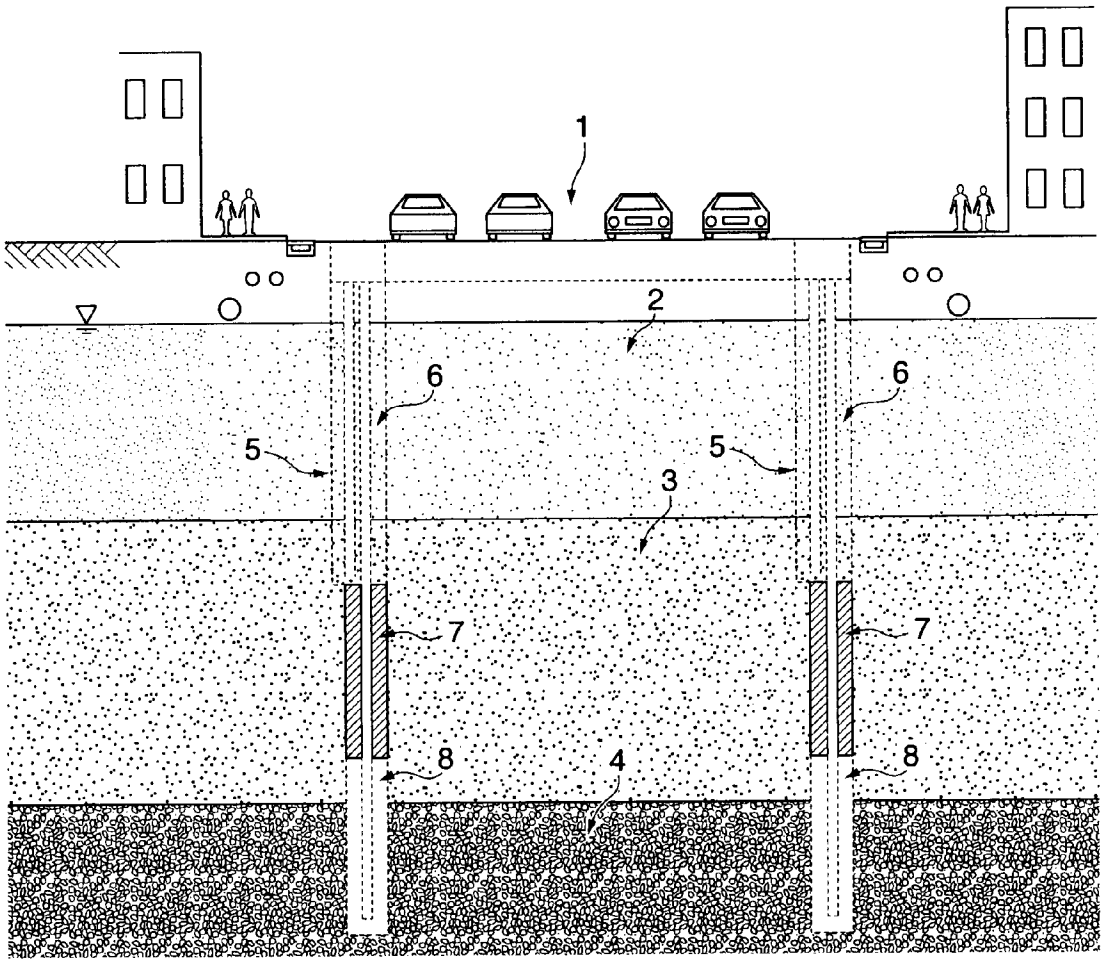

FIG. 13 is a cross sectional view as illustrated in FIG. 12 showing the state of the ground after all those facilities used for executing the method of the present invention have been removed and the hollow spaces where the ditches and well have been removed are filled back tightly to recover the original density of the ground before said facilities were installed.

Figure 14:
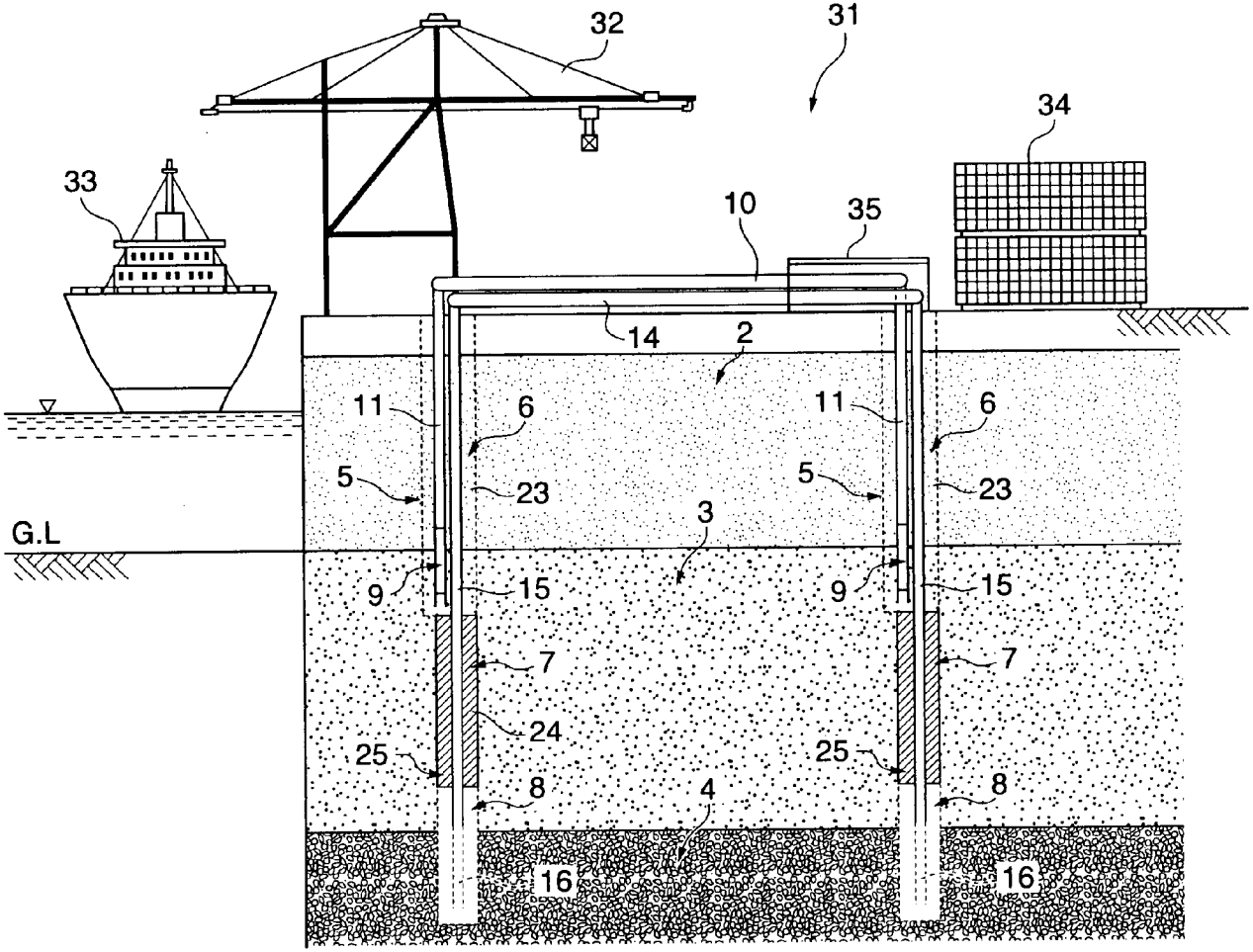

FIG. 14 is a cross sectional view illustrating an example where the method of the present invention is applied to a container wharf where such pipes as main water pipe and reverse flow main pipe may be placed on the pavement covering the ground surface in which a short portion of those pipes covered is covered with a cover board. Therefore, it is much easier to set or to remove those parts used for the method of the present invention than where said method is applied to a street.

DETAILED DESCRIPTION OF THE EMBODIMENT

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

To describe a typical application of the present invention in reference to drawings, the present invention as defined in the first object, the second object, the third object, the fourth object, the fifth object, the sixth object, the seventh object, the eighth object and/or the ninth object as well as the tenth object of the present invention is applicable to the ground beneath an urban street in a densely built-up area, a dry riverbed of a river, a ground under water wherever there is not any such an constant groundwater seepage flow the flow rate of which exceeds a normal rate of seepage flow.

First of all, it must be emphasized that the air dissolved overly saturated in said tap-water is able to be drawn out of said tap-water to form countless tiny air bubbles as described in the fourth object of the present invention only at the case where there is an adequate dose of the micro particles of said mineral powder forming the cores for drawing air out of said tap-water and there is such a fall in the pressure of said tap-water made when said tap-water at normal pressure flows out of a water tap.

Otherwise, air does not dissolve out of said tap-water even though said tap-water is overly saturated with air, and no air bubbles form in said tap-water.

The present invention is particularly suitable for application to such a place as an urban street and/or a harbor area where the space over the ground surface is used for such busy activity as traffic and/or as cargo handling work. The present invention is also well suited to ground under the water of gently streaming river.

The present invention is most suitably applicable to such a place as an urban street and/or a harbor area in a densely built-up area where the ground below such a place is formed with loose fine grained fill overlaying a soft cohesive layer like the one called New Bay Mud underlain by a deep granular layer prevailing along the sea shore of the West Coast of North American Continent where there is one of the most active earthquake zones in the World stretching along the San Andreas Fault extending from its northern end in Alaska all the way down southward to Mexico.

Because the facilities used for achieving the object as defined by the first object of the present invention are handy and easily retrievable, the method of the present invention is particularly suitable for the application to said urban street and/or a harbor where the space over the ground surface is used for busy activity as described afore.

The present invention is also suitably applicable to such a place as below a viaduct of low head clearance as well as on a narrow space such as a lane where any heavy duty equipment like a crawler mount pile driving machine is not permitted to approach.

The present invention is further applicable to a sub-aqueous place without using any floating equipment such as heavy duty pushers and/or barges like the ones used for building the Trans Bay Tube for sub-aqueous rail tunnels crossing San Francisco Bay by Bay Area Rail Transit in or around 1965 through 1975.

Before describing the application of the method of the present invention, the technical background of the method of the present invention as described below is to be mentioned.

The aforementioned loose fine grained layer underlain with the soft cohesive layer nearly saturated with groundwater is vulnerable to seismic liquefaction with very rare exception as repeatedly described afore.

According to the report on result of torsional shearing tests coauthored by Keizo Tanaka, Yoshiaki Yoshimi and Koji Tokimatsu titled "The Influence of Repeated Torsional Shearing Tests to the Saturation Degree of Sand, Symposium on Recent Status of Study on Technical Property of Unsaturated Soil, Jap. Geotech. Eng. Soc., 1987, pp. 225–228, the very loose samples of Toyoura Sand the saturation degree of which was not higher than 84% did not fail by the repeated action of highest possible shearing stress.

According also to the report on result of subsurface exploration, described in ongoing paragraph which was made by Tatso Sakai of Kiso Jiban Consultants, Inc. a top ranking soil engineering firm in Japan under the contract owned by Shiraishi Corporation where the claimant for the patent of present invention was honorary chairman conducting the above subsurface exploration, issued by a Foundation Juridic Person Railway General Research Institute titled "Report on Investigation and Measuring Saturation Degrees of Ground Surrounding Pneumatic Caisson Foundation", 1998, pp. 1–34, the measured values of saturation degree in said loose fine grained sandy soil fall in the range of 83.5% through 92.4%.

In addition to the above report, it should be mentioned that, despite the loose fine grained ground surrounding 305 pneumatic caissons supporting viaducts, bridges and a blast furnace, those structures could endure the violent tremor, the maximum horizontal acceleration of which was so high as to be close to the acceleration of gravity caused by Hyogoken Nambu Earthquake of 1995, without fatal damage, while a great many number of other such structures, including viaducts, bridges, buildings and the like built on such foundations as piles, open caissons or the like were fatally damaged by said Earthquake.

It was verified, that the forming of countless micro capillary tubes made piercing into the clogged pore voids as defined in the fourth object of present invention described in foregoing paragraphs by the result of an experiment made by said Kiso Jiban's laboratory in Tokyo under the contract owned personally by the claimant for a patent of the present invention.

The sample of sandy gravel, its pore voids filled up with boring mud at the pressure of 0.07 MPa (0.7 kgf/sq. cm) in an air-tight container of acrylic tube 10 cm in inside diameter and 50 cm high containing, from the top end down, a synthetic rubber top board tightly fixed down to the top end of said acrylic tube, a 20-cm deep water, said sample of boring mud 30 cm deep underlain with a porous stone board and a synthetic lubber bottom board tightly fixed up to the bottom end of said acrylic tube with a drain hole, was placed on a testing table.

The compressed air pressurized at 0.12 MPa was allowed to flow into said acrylic tube through a pipe built in the top board to replace said 20-cm deep water being pushed out through the relief valve built also in said top board until the vacant space below said top board was filled up with compressed air.

Then, the compressed air pushed into said boring mud to let it bore countless micro capillary tubes pierced through said mud, filling the pore voids of said sample of sandy gravel, and the air pushed in through said capillary tubes blew out downward through said porous stone board.

By the result of above experiment, it was made clear the compressed air at the pressure not higher than 0.12 MPa pierces countless micro capillary tubes into such a wet muddy clog choking pore voids of granular ground similar to said sample of sandy gravel in which its pore voids were filled up with boring mud.

The most popular siliceous material that is chemically stable and harmless in and suitable to underground use extensively and available everywhere in the world is silicon dioxide or silica. Silica is a principal component of crystallized volcanic ash. It exists in a more purified form as quartz, crystal and the like.

Before describing the details of applying the present invention, it must be noted that the property of said fine grained layer is not as uniform as assumed in composing the procedure of applying the method of the present invention. Even in rather uniform alluvial deposits there are patches of loose spots or weak strips.

In relatively uniform media, the groundwater does not permeate as uniformly as the theory of steadily permeating flow may suggest. Instead, a phenomenon called fingering makes several water heads of finger like shape permeate much faster through loose strips than said theory may suggest. This sort of irregularity is exaggerated in reclaimed ground.

In a broad extent of reclaimed fill there are a number of zones in which the fast permeating finger tips of flow reach their final goals far ahead of slow permeating tips of flow.

In the United States where the coefficient of permeability in the shallower zone of said loose fine grained layer is smaller than the one in the deeper zone, the final goal whereat any one of those fingering flow tips of water may touch may be the bottom base level of street pavement. However, the hydraulic pressure in every zone is kept steadily at the predetermined level until the time when the last finger tip of said permeating flow reaches its goal. The flow rate may then be diminished to a minimum when said last water tip reaches its goal.

Soon after diminishing of the flow rate to minimum rate is detected by said water-flow meter, then the supply water valve is closed to make the head level of said tap-water fall down to the initial groundwater level so as to form an air-mixed zone of countless tiny air bubbles in the pore water of loose fine grained layer as defined in the first object of the present invention.

Also, before describing an example of an application of the present invention, the difference in grain size distribution of said loose fine grained layer between the coastal cities facing the eastern seashore of Japan and of said loose fine grained layer prevailing along the seashore of the West Coast of the United States should be mentioned.

The grain size distribution of said loose fine grained layer in said coastal cities of Japan is the result of a natural deposit in geological history of world wide rising sea water surface during the ending period of the last glacial epoch where the grain size in shallower depth is not finer than the one in greater depth.

By contrast, the grain size of said loose fine grained layer prevailing along the West Coast sea shore of the United States is reclaimed fill, with the exception of a very rare case of natural deposit, where the grain size in shallower depth is finer than the one in greater depth.

Figure 1:
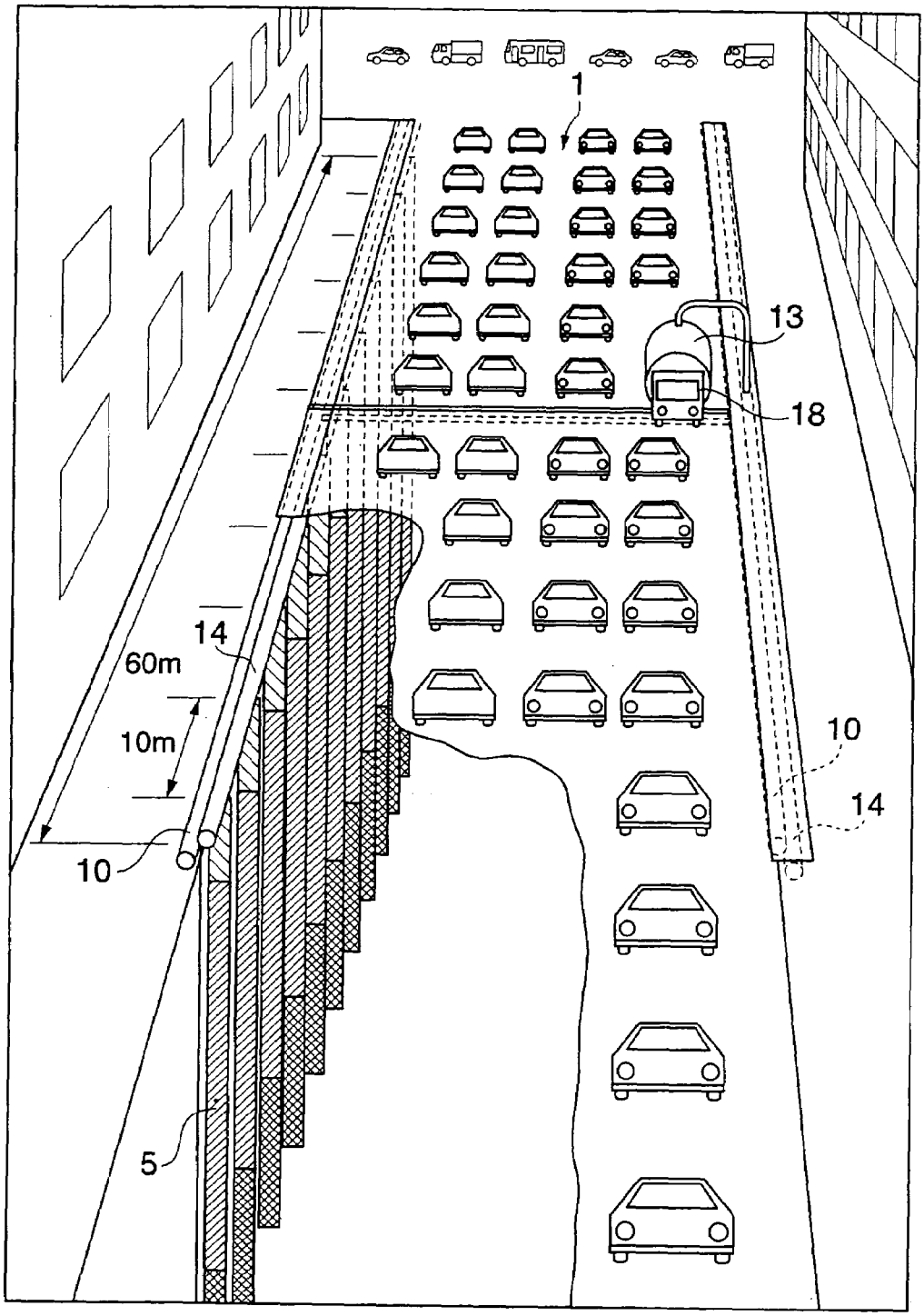
FIG. 1 is a perspective front view illustrating schematically an example of the equipment placed on and the pipes placed below the pavement of a street in a densely built-up urbanized area occupied by rows of vehicular traffic for executing the method of the present invention.

To describe an example of an application of the present invention in reference to the drawings of FIG. 1 and FIG. 2 showing the example where the present invention is applied to the loose fine grained layer underlying a municipal street in densely built-up urbanized area.

Regarding the entire aspect of the method for preventing seismic liquefaction of the present invention will be described in reference to FIG. 2.

Below a street 1 there is a loose fine grained layer 2 which is the object of the method for preventing seismic liquefaction of ground underlain by the soft cohesive layer 3 liable to uneven settlement caused by its consolidation and the bottom granular layer or deep granular layer 4 lies underneath said soft cohesive layer 3.

The rows of wells 5 placed at a predetermined interval along both side lines of the roadway running through street 1 being the method for preventing seismic liquefaction of ground to be executed in the boundary in between the both outside lines of the street 1 are bored down into the deep granular layer 4.

Said wells 5 include rows of top wells 6 extending down through the loose fine grained layer 2 into the top portion of soft cohesive layer 3, the rows of middle wells 7 extending down from the bottom of the top wells 6 to the bottom portion of the soft cohesive layer 3 and the rows of bottom wells 8 extending down from the bottom end of the middle wells 7 into deep granular layer 4.

In an example of application of the method of the present invention, the holes forming top wells 6 are to be bored by a boring method for boring holes without disturbing the ground surrounding the bored holes such as All Casing Method labeled in Japan or by a boring machine like the one once made by the Italian firm Benoto or the one labeled Reverse Circulation Method. The holes forming the middle wells 7, the diameter of which are approximately half the diameter of top wells 6, may be bored by a boring machine used for boring holes of deep wells or the like.

However, the method for boring holes of wells 5 should be selected to suit the work site situation, for instance in a densely built-up urban area, to avoid using tall machines in the site where the head clearance is low and to suitably select using low head machines suitable for the use under a low head clearance.

In top well 6 of said well 5, submerged pump 9 is coupled to the lowest end of branch water pipe 11 which is tied up to main water pipe 10 connected upward to air-tight tank 13 where water check valve 12 is inserted shortly below the low end of air-tight tank 13 placed on the ground surface at the most adequate position in the work site.

At the position immediately below water check valve 12 inserted in water main pipe 10, is a water-flow sensor (not shown) linked electronically to the means (not shown) for regulate driving submerged pump 9.

A pressure sensor (not shown) is set inside air-tight tank 13. Rows of reverse flow branch pipe 15 tied up to reverse flow main pipe 14 extend down into bottom well 8, the lowest portion of which is perforated to convert it into perforated pipe 16.

A reverse flow main pipe 14 is coupled to said air-tight tank 13 through a main valve 17 inserted in between them.

An air compressor 18 placed near air-tight tank 13 is connected to air-tight tank 13 with an air check valve 19 inserted in between them.

The means (not shown) for operating the air compressor 18 is linked electronically to the pressure sensor set inside air-tight tank 13.

An air-flow rate meter (not shown) is installed in between air compressor 18 and air-tight tank 13.

As illustrated in FIG. 2, main water pipe 10 and reverse flow main pipe 14 are placed in each side ditch 20 formed along both sides of the roadway of street 1 and in a cross ditch 21 formed across the roadway of street 1.

Because both the side ditches 20 and cross ditch 21 are covered with cover board 22, they do not obstruct any free movement of traffic on the roadway of street 1 while the method for present seismic liquefaction of ground is executed.

The top permeable section 23 is formed incorporating top well 6 of said well 5 filled up with such a permeable material as crushed stone of adequate grain size.

The middle impermeable section 24 is formed incorporating middle well 8 filled up with such an impermeable material as bentonite paste.

And the deep permeable section 25 is formed incorporating bottom well 8 filled up with such a permeable material as crushed stone of adequate grain size.

A sensor (not shown) to detect lowering of groundwater table in loose fine grained layer 2 down to its bottom level is placed in top permeable section 23 incorporating top well 6.

Said sensor is linked electronically to the means to regulate driving (not shown) submerged pump 9 installed at lowest portion in top well 6.

The means to regulate driving (not shown) submerged pump 9 installed in the lowest portion of top well 6 is linked electronically to said sensor for detecting the level of groundwater table.

A couple of longitudinal perforated pipes 26 are installed by a small-diameter pipe pushing method or the like stretching along each outside boundary of street 1 covering the area which is the object of executing said method of the present invention for preventing seismic liquefaction of ground at the depth close to the top level of soft cohesive layer 3.

An adequate amount of pressurized water containing countless micro air bubbles produced by means (not shown) installed on the ground surface is supplied into said longitudinal perforated pipe 26 for blowing out to form a hardly-permeable micro air bubble barrier 27 similar in shape to an inverted upside-down curtain formed by countless micro air bubbles which is made in loose fine grained layer 2 alongside or close to each outside periphery of the street 1 by blowing said pressurized water containing countless micro air bubbles out of said longitudinal perforated pipe 26 upward.

This hardly-permeable micro air bubble barrier 27 thus formed plays a role of minimizing the harmful influence of uneven settlement of buried utilities, underground structures and the like laying along the outside periphery of the area, where the method for preventing seismic liquefaction of ground is to be executed, caused by lowering of groundwater table.

The process of executing the method of the present invention for preventing seismic liquefaction of ground is described in reference to FIGS. 3 through 13 as follows.

Figure 3:
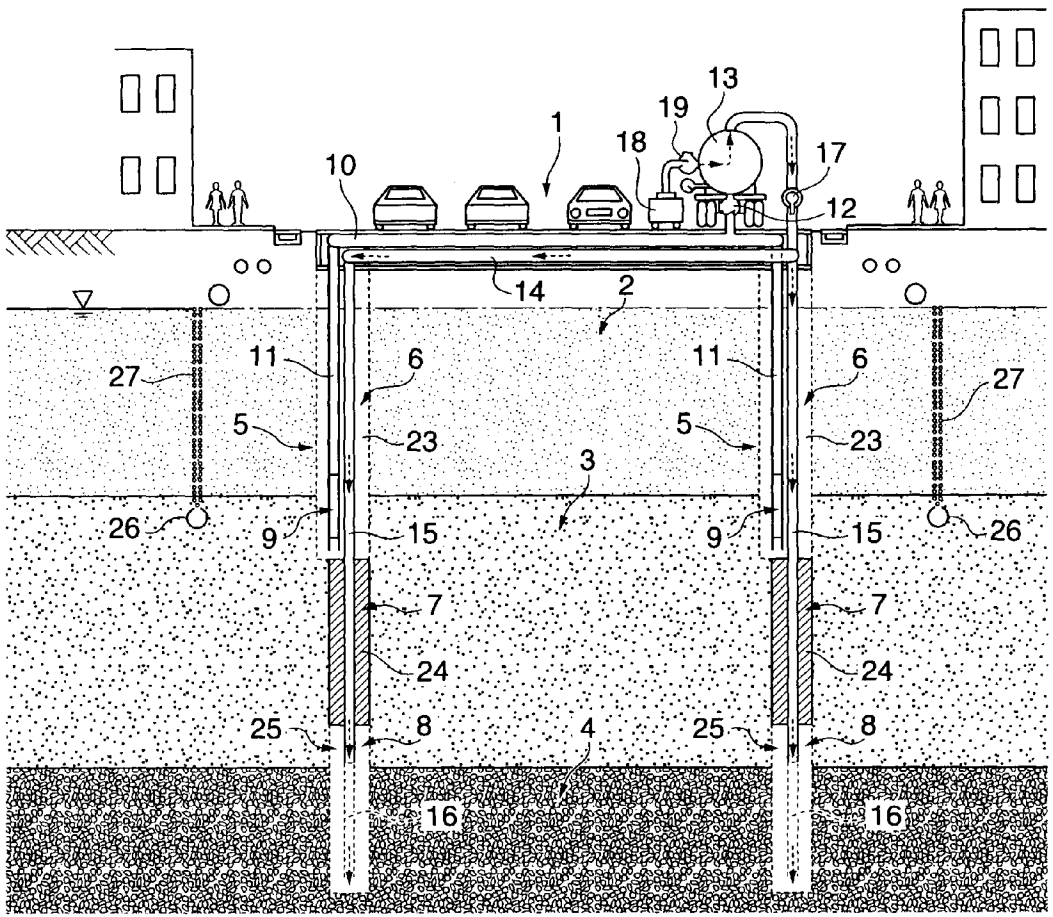
FIG. 3 is a cross sectional view as illustrated in FIG. 2(*a*) at the stage before the groundwater in the loose fine grained layer is pumped out when the clog formed while the bottom well is bored and/or at the stage soon after the flow rate of groundwater pumped out of said loose fine grained layer is lowered below a predetermined rate. An air compressor linked to a flow-meter automatically starts blowing compressed air through an air check valve, an air-tight tank, a main valve, a reverse flow main pipe and a reverse flow branch pipe down into the clog formed by dusty particles drawn out of the loose fine grained layer together with the groundwater pumped out of it and the compressed air thus blown onto said clog pierces into the countless micro capillary tubes into the clog to clear the choking around the bottom well so as to resume the original rate of water flow.

As shown in FIG. 3, compressed air is supplied from air compressor 18 through air check valve 19 into air-tight tank 13. When the pressure in air-tight tank 13 rises up to a predetermined level and is detected by a sensor, main valve 17 of reverse flow main pipe 14 is made open to make compressed air flow through reverse flow main pipe 14, and reverse flow branch pipe 15 to blow out of perforated pipe 16 installed in bottom well 8 bored into deep permeable section 25.

The blowing of compressed air out of perforated pipe 16 forms countless micro capillary tubes into the clog filled with drilled dust formed by drilling the bored hole of well 5.

As a result of the above forming of said capillary tubes, permeability of the clogged portion of deep permeable section 25 is raised to rapidly increase the flow rate of compressed air blowing into deep permeable section 25.

As soon as the air-flow meter of air compressor 18 detects the rapid increase in air-flow rate rising up to the predetermined rate, the operation of air compressor 18 is interrupted in order not to feed an excessive amount of compressed air. Controlling the amount of compressed air is partly for preventing the forcing of harmful gas or odor of sewage and the like up out of the ground, partly for reducing the expenditure of time and money needed for driving the air compressor 18 unnecessarily, and partly for preventing the rare occurrence of dangerous oxygen-short air.

Soon after the driving of air compressor 18 is interrupted, driving of the submerged pump 9 installed in top well 6 bored into top permeable section 23 is commenced as illustrated in FIG. 4.

By commencing the driving of the submerged pump 9, the groundwater in loose fine grained layer 2 is pumped out through branch water pipe 11, main water pipe 10, water check valve 12 and made to flow into air-tight tank 13.

The groundwater thus pumped out up into air-tight tank 13 flows after being stored to fill up air-tight tank 13, flows through reverse flow main pipe 14, into reverse flow branch pipe 15, into perforated pipe 16 down into deep granular layer 4.

Even though the amount of very fine particles pumped out of the loose fine grained layer 2 together with the water pumped out of submerged pump 9 is regulated to be minimized by water-flow sensor (not shown) linked electronically to submerged pump 9, it is not able to prevent accumulating very fine dusty particles to form clogs in the pore voids of deep granular layer 4.

The above clogging formed in deep granular layer 4 makes it more difficult for the pumped out water to permeate into deep granular layer 4, causing a decrease in the amount of water flowing into deep granular layer 4.

As soon as the water-flow sensor (not shown) linked electronically to the means driving the submerged pump 9 detects the decrease in flow rate to lower than a predetermined rate, driving of submerged pump 9 is interrupted.

Supply of compressed air is automatically resumed by starting to drive the air compressor 18 when the lowering of water pressure in air-tight tank 13 as the result of interruption of pumping groundwater out by submerged pump 9 is detected by the pressure sensor linked to electronically to the means of driving (not shown) air compressor 18.

The above resumed supply of compressed air raises the pressure in air-tight tank 13, opens main valve 17 in reverse flow main pipe 14, and feeds compressed air through reverse flow main pipe 14, reverse flow branch pipe 15, perforated pipe 16 and down to blow out into deep granular layer 4.

The dusty particles mixed into the groundwater pumped out by thus pumping form clogs in the pore voids of deep granular layer 4 surrounding bottom well 8 to decrease the amount of water flowing out into said deep water bearing layer 4.

Then, the amount of water flowing out into deep granular layer 4 resumes increasing through the countless micro capillary tubes formed into the clogging by the compressed air blown at and pierced into the clogging.

As soon as the increase in compressed air flow rate thus raising rapidly up to a predetermined level is detected by said air-flow meter, the driving of air compressor 18 is automatically interrupted.

As shown in FIGS. 5 through 8, the level of groundwater table is lowered in such a gentle pace as to minimize the amount of very fine particles flowing out by pumping groundwater pumped out of loose fine grained layer 2 by repeating the cycles of pumping groundwater out of loose fine grained layer 2 and blowing compressed air into the clogging choking pore void of deep granular layer 4.

When said water-level sensor detects the level of groundwater table being thus lowered down to its bottom depth as is shown in FIG. 8, the driving of submerged pump 9 is automatically stopped to suspend pumping groundwater out of loose fine grained layer 2.

As shown in FIG. 9, soon after the groundwater table in loose fine grained layer 2 lowers down to its bottom level by pumping groundwater out of it, the connection between air-tight tank 13 and reverse flow main pipe 14 is dismantled, water check valve 12, air-tight tank 13, main valve 17, air compressor 18 and air check valve 19 are removed for repeated use.

While tap-water made to flow out of the open supply water valve 30 flows into regulating tube 28 which is coupled to the top end of main water pipe 10, the draining end of reverse flow main pipe 14 is placed on a side ditch.

In regulating tube 28, an adequate dose of micro-particles of said mineral powder is blended together with required amount of diffusing agent blended in said tap-water as defined in the first object of the present invention described afore in ongoing paragraphs.

After said tap-water thus prepared is made flow through main water pipe 10, branch water pipe 11 and flow out into top permeable section 23 surrounding top well 6 and further permeate into the aerated pore voids of loose fine grained layer 2.

While said tap-water is prepared in regulating tube 28 and permeated into loose fine grained layer 2 as described above, the groundwater exuding out of deep granular layer 4 is drained into the nearest side ditch of street 1 after it flows up through the rows of reverse flow branch pipe 15 and reverse flow main pipe 14 laid across below the pavement of roadway in street 1.

As shown in FIGS. 9 through 12, shortly after the tap-water prepared as described above is made permeate into the aerated pore voids of loose fine grained layer 2, the permeating front of said tap-water shown by bold chain lines draws out of the bottom ends of rows of top wells 6 laid along each outer side of roadway of street 1.

By thus permeating flow into loose fine grained layer 2, the hydraulic head level of said tap-water falls to the initial water level shortly after supply water valve 30 is closed to cut the supply of said tap-water permeating into loose fine grained layer 2.

Then countless tiny air bubbles are forced in pore voids of loose fine grained layer 2 by the air overly dissolved in said tap-water.

These countless tiny air bubbles bubble or separate out of said tap-water by making the micro-particles of said mineral powder as cores for bubbling or separating out of said tap-water. Otherwise, where there would be no such cores like the micro-particles of said mineral powder, air bubbles could not bubble or separate out of said tap-water even though such tap-water is overly saturated with the air dissolved into it.

By forming these countless tiny air bubbles crowding around said cores of micro particles of said mineral powder, the saturation degree in the loose fine grained layer 2 is lowered to the level at which no seismic liquefaction takes place even at the time of a disastrously violent earthquake.

The sufficiently low saturation degree in the pore voids of loose fine grained layer 2 thus lowered is kept steady semi-permanently unless it is disturbed by such radical change as in temperature in groundwater caused by volcanic action the probability in occurrence of such a natural hazard is minimum.

The surface layer laying in between the surface of street 1 and the top surface of loose fine grained layer 2 (in the example shown in FIGS. 2 through 13, the top surface level of loose fine grained layer 2 coincides with the level of groundwater table) is a hardly permeable fill With a very rare exception, the down-town areas on low level fill on relatively new geological deposit in large coastal cities is made mostly of the material cut out of the up town area or dredged out of shallow off-shore sea bed.

In the area where, with a very rare exception, said surface layer laying in between the surface of street 1 and the top surface of loose fine grained layer 2 is not a hardly permeable fill, said tap-water to be poured into loose fine grained layer 2 may permeate up through the gaps between the pavement of street 1 and those obstacles as top well 6, man holes and the like extruding up through the pavement of street 1 by the amount of tap-water in excess of the amount to fill the pore voids of loose fine grained layer 2 up to the limit level of its top surface making said tap-water to flow up above the pavement of street 1.

In such an above mentioned case, it is recommended to plug those gaps between the pavement of street 1 and the obstacles as top well 6, man holes and the like by grouting such an impermeable material as bentonite paste.

As shown in FIG. 13, such buried pipes as main water pipe 10, branch water pipe 11, reverse flow main pipe 14, reverse flow branch pipe 15 are removed for retrieval.

The process of forming longitudinal permeable micro air bubble barrier 27 is interrupted before longitudinal perforated pipe 26 is removed by pulling longitudinal perforated pipe 26 for retrieval as well as the pipes placed in side ditch 20 and cross ditch 21 together with cover board 23 are removed as much as it is practicable to retrieve them without any excessive effort worthwhile to do it.

An example of applying the method of present invention to a container wharf built on reclaimed ground is illustrated in FIG. 14, because, in the case where said method is applied to a container wharf, such pipes as main water pipe 10 and reverse main water pipe 11 may be placed on the ground surface and covered only with a short cover board for wharf 35, it may be easier to simply place and retrieve those facilities than to install them buried and covered inside rows of ditch of street 1.

In FIG. 14, illustrated are container wharf 31, container crane 32, container vessel 33, and container 34. Because a container wharf 31 is usually built on a reclaimed ground and the tidal changing surface level of sea water varies with the location of harbors, any detail in dimension of sea water level above ground level (G.L) is not shown in FIG. 14.

Therefore, the following effect may be achieved.

That is, because, as defined by the first object of the present invention described in the ongoing paragraphs by utilizing the method for preventing seismic liquefaction by lowering the saturation degree in the entire extent of said loose fine grained layer 2, said saturation degree in the entire extent of said loose fine grained layer 2 could be lowered and the lowered saturation degree maintained by forming an air mixed zone containing uniformly countless tiny air bubbles formed by the air dissolved out of said tap-water overly saturated with air dissolved in it wherein a suitable dose of said mineral powder is blended.

Said countless tiny air bubbles are dissolved out swarming around the cores of micro particles of said mineral powder contained in said tap-water at an adequate pressure injected gently into the aerated pore voids of loose fine grained layer 2.

The pore voids of loose fine grained layer 2 are aerated by pumping ground water out of them while the pumped out groundwater is made flow down into the deep granular layer 4 to raise the uplifting force combined with the reciprocally supplied compressed air the pressure of which is made properly higher than the groundwater pressure at the top level of deep granular layer 4 counteracts the downward force caused by dewatering said loose fine grained layer 2 to prevent uneven settlement due to said dewatering loose fine grained layer 2 so as to achieve fully the effect as defined in the first object described above safely and economically.

As defined by the second object of the present invention described in the ongoing paragraphs by utilizing the method for preventing seismic liquefaction by lowering the saturation degree in loose fine grained layer 2 by using required number of bored well 5 the entire depth of one of them is divided into top well 6, middle well 7 and bottom well 8 where each one of them have its function adaptable to the property of the ground surrounding it so as to make it able to achieve fully the effect as defined in the second object described above safely and economically.

As defined by the third object of the present invention described in the ongoing paragraphs by utilizing the method for preventing seismic liquefaction by lowering the saturation degree in loose fine grained layer 2 by boring large diameter holes for top well 6 bored by means of such a method of boring hoes without disturbing the ground surrounding the bored holes as "all casing method" or the like and boring holes for middle well 7 and bottom well 8 underlying top well 6 bored by means of boring equipments commonly used for boring deep well so as to achieve fully the effect as defined in the third object described above safely and economically.

As defined by the fourth object of the present invention described in the ongoing paragraphs by utilizing the method for preventing seismic liquefaction by lowering the saturation degree in loose fine grained layer 2 by making it easier the pressurized groundwater permeating into the clogged pore voids formed by accumulation of fine dusty particles in the ground surrounding deep permeable section 25 cleared with countless micro capillary tubes formed by injecting compressed air reciprocally with the pressurized ground water pumped out of loose fine grained layer 2 each one of those liquids at the predetermined level of pressure, said groundwater containing the dusty particles drawn out of loose fine grained layer 2 pumped up out of said layer 2 together with groundwater through air-tight tank 13, reverse flow water pipe 15 down into deep permeable section 25.

The reversed flow of groundwater through said countless micro capillary tubes formed in through said clogging makes uplifting liquid pressure combined with said compressed air acting up at the bottom surface of soft cohesive layer 3 high enough for preventing any uneven settlement caused by lowering groundwater level in said loose fine grained layer 2 so as to make it able to achieve the combined effect of compressed air and pressurized groundwater as defined in the four the object described above safely and economically.

As defined by the fifth object of the present invention described in the ongoing paragraphs by utilizing the method for preventing seismic liquefaction, in an event said method for preventing seismic liquefaction is to be applied inside a specified range of area where there are, close to the outside periphery, such underground utilities, buried structures or the like liable to harmful uneven settlement caused by a temporary lowering of groundwater level in loose fine grained layer 2 are placed, any damage caused by said uneven settlement is minimized by providing hardly permeable barrier 27 formed with countless micro air bubbles blown out of each one of a couple of longitudinal perforated pipe 26 placed alongside of an outside periphery of street 1 so as to make it able to achieve the effect as defined in the fifth object described above safely and economically.

As defined by the sixth object and the seventh object of the present invention described in the ongoing paragraph by utilizing the method for preventing seismic liquefaction, since it is made able to minimize the amount of fine dusty particles drawn out of loose fine grained layer 2 together with the groundwater pumped out of it causing clogging formed by the said fine particles while the groundwater containing said fine dusty particles drawn out of said loose fine grained layer 2 is made flow out of bottom well 8 into deep permeable section 25 so as to make it able to achieve fully the effect as defined in the sixth object and the seventh object described above safely and economically.

As defined by the eighth object of the present invention described in the ongoing paragraphs by utilizing the method for preventing seismic liquefaction, it is made able to automatically regulate pumping groundwater out of loose fine grained layer 2 as well as to make pressurized groundwater flow and compressed air blowing reciprocally down into deep granular layer 4 so as to make it able to achieve fully the effect as defined in the eighth object described above safely and economically.

As defined by the ninth object of the present invention described in the ongoing paragraphs by utilizing efficiently the method for preventing seismic liquefaction, it is made able to limit the amount of compressed air for the purpose to clear the clogging formed in deep water bearing layer 4 surrounding bottom well 8 so as to make it able to achieve fully the effect as defined in the ninth object described above safely and economically.

As defined by the tenth object of the present invention described in the ongoing paragraph by utilizing the method for preventing seismic liquefaction, it is made able to execute efficiently the method for preventing seismic liquefaction by providing all the facilities utilized for the method for preventing seismic liquefaction small and compact to adapt them for the limited environment of built-up urban area minimizing the vacant gap on street 1 so as to make it able to achieve the effect as defined in the tenth object described above safely and economically.

The foregoing is considered as illustrative only of the principles of the present invention.

Further, since numerous modifications and variations will readily occur to those skilled in the art, it is not desired to limit the present invention to the exact constructions and operations shown and described, and, accordingly, all suitable modifications and equivalents which may be resorted to, fall within the scope of the present invention.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A method for preventing seismic liquefaction of ground in a built-up urban area where a loose fine-grained layer vulnerable to seismic liquefaction is underlain with a soft cohesive layer liable to uneven settlement caused by lowering of a groundwater table, with a deep granular layer underlying said soft cohesive layer, said method comprising the steps of:

pumping pore water out of said loose fine-grained layer to lower the groundwater table and thereby create pore voids in said loose fine-grained layer;

pressurizing and pushing said pumped pore water down through said soft cohesive layer into said deep granular layer, an uplift force of said pumped pore water counteracting a downward force caused by the lowering of the groundwater table in said loose fine-grained layer;

blending tap water saturated with dissolved air, micro particles of mineral powder and a diffusing agent in a regulating tube as a tap water mixture;

injecting said tap water mixture into said pore voids in said loose fine-grained layer until said pore voids are filled; and forming, following completion of the foregoing step of injecting said tap water mixture, an air-mixed zone in which a plurality of air bubbles make cores of the micro particles of said mineral powder and are thereby bubbled out of said mixture such that a degree of pore water saturation in said loose fine-grained layer is reduced to prevent seismic liquefaction due to earthquake.

2. The method as set forth in claim 1, wherein said method includes boring a plurality of wells at spaced intervals along each side of a street, each of said wells extending into said deep granular layer.

3. The method as set forth in claim 2, wherein said step of boring said plurality of wells includes forming, for each well, a top well extending through the loose fine-grained layer into a top portion of said soft cohesive layer, a middle well extending from a bottom of said top well to a bottom portion of said soft cohesive layer, and a bottom well extending down from a bottom end of said middle well into said deep granular layer.

4. The method as set forth in claim 3, wherein said step of forming said top well, said middle well and said bottom well includes filling said top well and said bottom well with a permeable material, and filling said middle well with an impermeable material.

5. The method as set forth in claim 1, wherein said step of pressurizing and pushing said pumped pore water down through said soft cohesive layer into said deep granular layer is performed while reciprocally injecting compressed air into said deep granular layer to open pore voids clogged by accumulated dusty particles drawn out with the pore water being pumped out of said loose fine-grained layer.

6. A method for preventing seismic liquefaction of ground in a built-up urban area where a loose fine-grained layer vulnerable to seismic liquefaction is underlain with a soft cohesive layer liable to uneven settlement caused by lowering of a groundwater table, with a deep granular layer underlying said soft cohesive layer, said method comprising the steps of:

pumping pore water out of said loose fine-grained layer to lower the groundwater table from an initial groundwater level to a bottom level of said loose fine-grained layer and thereby create pore voids in said loose fine-grained layer;

pressurizing and pushing said pumped pore water down through said soft cohesive layer into said deep granular layer while injecting compressed air into said deep granular layer at a pressure greater than a groundwater pressure at a bottom level of said soft cohesive layer, an uplift force of said compressed air and said pumped pore water counteracting a downward force caused by the lowering of the groundwater table in said loose fine-grained layer;

blending tap water saturated with dissolved air, micro particles of mineral powder and a diffusing agent in a regulating tube as a tap water mixture;

injecting said tap water mixture through a supply valve into said pore voids in said loose fine-grained layer until said pore voids are filled; and closing said supply valve to make a head level of said tap water mixture fall down to the initial groundwater level, a plurality of air bubbles dissolved in said mixture making cores of said micro particles of said mineral powder and thereby bubbling out of said mixture to reduce a degree of pore water saturation in said loose fine-grained layer to prevent seismic liquefaction due to earthquake.

7. The method as set forth in claim 6, wherein said method includes boring a plurality of wells at spaced intervals along each side of a street, each of said wells extending into said deep granular layer.

8. The method as set forth in claim 7, wherein said step of boring said plurality of wells includes forming, for each well, a top well extending through the loose fine-grained layer into a top portion of said soft cohesive layer, a middle well extending from a bottom of said top well to a bottom portion of said soft cohesive layer, and a bottom well extending down from a bottom end of said middle well into said deep granular layer.

9. The method as set forth in claim 8, wherein said step of forming said top well, said middle well and said bottom well includes filling said top well and said bottom well with a permeable material, and filling said middle well with an impermeable material.

10. The method as set forth in claim 9, wherein said permeable material is crushed stone and said impermeable material is bentonite paste.

11. The method as set forth in claim 8, wherein said steps of forming said top well, said middle well and said bottom well includes boring said middle and bottom wells to have a diameter half a diameter of said top well.

12. The method as set forth in claim 8, wherein said step of pressurizing and pushing said pumped pore water to flow down through said soft cohesive layer into said deep granular layer while injecting compressed air into said deep granular layer includes injecting said compressed air reciprocally with said pore water flow to open pore voids clogged by accumulated dusty particles drawn out with the pore water being pumped out of said loose fine-grained layer.

13. The method as set forth in claim 12, wherein said reciprocal injection of compressed air and pumped pore water is controlled using a pressure sensor to detect clogging and a flow rate meter to detect pore water flow rate in excess of a predetermined rate.

14. The method as set forth in claim 7, wherein said step of pressurizing and pushing said pumped pore water to flow down through said soft cohesive layer into said deep granular layer while injecting compressed air into said deep granular layer includes:

providing an air compressor at ground level connected to an airtight tank by an air pipe having an air check valve for holding a reverse flow of overly compressed air, said air-tight tank being connected by a main water pipe to submerged pumps in a bottom of said wells;

providing a reverse flow main pipe extending from said air-tight tank to a bottom of said wells with a water main valve inserted therebetween;

operating said submerged pumps to pump out groundwater into said air-tight tank which pressurizes the groundwater for pumping into said deep granular layer through said reverse flow main pipe with said water main valve open;

suspending the flow of pressurized water into said deep granular layer by closing said water main valve in said reverse flow main pipe upon detection in said main water pipe of a rise in pressure in excess of a predetermined level indicating a clog;

operating the air compressor to force compressed air into said deep granular layer to remove the clog; and resuming operation of said submerged pumps to pump pressurized water into said deep granular layer upon detection of a pressure level indicating the clog has been removed.

* * * * *